US008803923B2

(12) United States Patent
Shimizu

(10) Patent No.: US 8,803,923 B2
(45) Date of Patent: Aug. 12, 2014

(54) DISPLAY APPARATUS AND DISPLAY METHOD

(75) Inventor: Masayoshi Shimizu, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 128 days.

(21) Appl. No.: 13/047,397

(22) Filed: Mar. 14, 2011

(65) Prior Publication Data

US 2011/0227962 A1 Sep. 22, 2011

(30) Foreign Application Priority Data

Mar. 16, 2010 (JP) ..... 2010-059978
Jun. 7, 2010 (JP) ..... 2010-130335

(51) Int. Cl.
*G09G 5/10* (2006.01)
*G09G 3/34* (2006.01)

(52) U.S. Cl.
CPC ..... *G09G 3/3426* (2013.01); *G09G 2320/0646* (2013.01); *G09G 2320/0653* (2013.01); *G09G 2320/0233* (2013.01); *G09G 2320/0247* (2013.01)
USPC ..... 345/690

(58) Field of Classification Search
CPC ..... G09G 2310/0237; G09G 2310/0233
See application file for complete search history.

(56) References Cited

U.S. PATENT DOCUMENTS

| | | | | |
|---|---|---|---|---|
| 2003/0142118 | A1 | 7/2003 | Funamoto et al. | |
| 2005/0184952 | A1 * | 8/2005 | Konno et al. | 345/102 |
| 2005/0231457 | A1 | 10/2005 | Yamamoto et al. | |
| 2006/0120082 | A1 | 6/2006 | Choo et al. | |
| 2007/0013636 | A1 * | 1/2007 | Lee et al. | 345/98 |
| 2010/0321414 | A1 | 12/2010 | Muroi et al. | |

FOREIGN PATENT DOCUMENTS

| | | | |
|---|---|---|---|
| EP | 1 744 300 | A1 | 1/2007 |
| EP | 2 337 012 | A2 | 6/2011 |
| JP | 2001-142409 | A | 5/2001 |
| JP | 2005-258403 | A | 9/2005 |
| JP | 2005-258404 | A | 9/2005 |
| JP | 2005-352269 | A | 12/2005 |
| JP | 2006-147573 | A | 6/2006 |
| WO | 2009/041574 | A1 | 4/2009 |

OTHER PUBLICATIONS

Extended European Search Report dated Jul. 27, 2012, issued in corresponding European Patent Application No. 11157990.0, (12 pages).
Japanese Office Action dated Jul. 16, 2013, issued in corresponding Japanese Patent Application No. 2010-130334 with partial translation (8 pages).

* cited by examiner

*Primary Examiner* — William Boddie
*Assistant Examiner* — Carolyn R Edwards
(74) *Attorney, Agent, or Firm* — Westerman, Hattori, Daniels & Adrian, LLP

(57) ABSTRACT

A display apparatus includes: an acceptance unit that accepts a first input image and a second input image; a light control unit that outputs a display image; a plurality of light sources that irradiate the light control unit; a light emitting amount computation unit that computes a first light emitting amount based on a luminance of the first input image and computes a tentative light emitting amount based on a luminance of the second input image, on a basis of a comparison result between the first light emitting amount and the tentative light emitting amount, imposes a limit on a change range from the first light emitting amount to a second light emitting amount, and decide the second light emitting amount; and a light source control unit that controls each of the plurality of light sources based on the second light emitting amount.

13 Claims, 23 Drawing Sheets

FIG. 4

140b

| LIGHT SOURCE IDENTIFICATION INFORMATION | LIGHT EMITTING AMOUNT HISTORY | | | |
|---|---|---|---|---|
| LIGHT SOURCE 120a | 50% | 55% | 60% | ··· |
| LIGHT SOURCE 120b | 50% | 50% | 60% | ··· |
| ⋮ | ⋮ | ⋮ | ⋮ | ··· |
| LIGHT SOURCE 120n | 50% | 50% | 60% | ··· |

DISPLAY APPARATUS AND DISPLAY METHOD

CROSS-REFERENCE TO RELATED APPLICATIONS

This application is based upon and claims the benefit of priority of the prior Japanese Patent Application No. 2010-59978, filed on Mar. 16, 2010 and No. 2010-130335, filed on Jun. 7, 2010, the entire contents of which are incorporated herein by reference.

FIELD

Embodiments discussed herein relate to a display apparatus and a display method.

BACKGROUND

A display apparatus that displays an image such as a liquid crystal display has a light control unit that controls a light transmittance and a light irradiation unit that supplies light to this light control unit. Among these, the light control unit corresponds to an LCD (Liquid Crystal Display) or the like, and the light irradiation unit corresponds to a back light such as an LED (Light Emitting Diode).

Herein, the light irradiation unit controls a light emitting amount in accordance with the largest luminance among respective luminances included in input images. Also, the light control unit controls the light transmittance on the basis of the respective luminances of the input images. To be more specific, the light control unit sets a high light transmittance for an area having a high luminance among the input images and displays the relevant area in a bright manner. On the other hand, by setting a low light transmittance for an area having a low luminance in the input image, the light control unit interrupts excess light and displays the relevant area in a dark manner. As the light irradiation unit and the light control unit operate in this manner, even when the area having the high luminance and the having the low luminance exist in a mixed manner in the input image, it is possible to appropriately display the input image in accordance with the respective luminances.

However, as a response speed of the light control unit is slower as compared with a response speed of the light irradiation unit, the control on the light transmittance by the light control unit may not manage to track a change in the light emitting amount by the light control unit, and a problem occurs that flicker is generated on a screen. This flicker is generated in an area other than an area having the largest luminance among the input images. In the following description, the area other than the area having the largest luminance is referred to as flat section.

FIG. 22 and FIG. 23 are explanatory drawings for describing the flicker generated in the flat section. FIG. 22 illustrates a relation between the light emitting amount with respect to the flat section, the light transmittance with respect to the flat section, and the luminance in the flat section in a case where the display apparatus displays input images is to is in the order of the input images 1*a*, 1*b*, and 1*c*. It is supposed that the input images 1*a* and 1*c* do not include images having a high luminance, and the input image 1*b* includes an image having a light luminance at one part. Also, a graph on the first stage from the top represents a time change in the light emitting amount with respect to the flat section, in which the vertical axis represents the light emitting amount, and the horizontal axis represents the time. A graph on the second stage from the top represents a time change in the transmittance with respect to the flat section, in which the vertical axis represents the transmittance, and the horizontal axis represents the time. A graph on the third stage from the top represents a time change in the luminance with respect to the flat section, in which the vertical axis represents the luminance, and the horizontal axis represents the time.

As illustrated in FIG. 22, the display apparatus sets the light emitting amount as 1A at a timing of displaying the input image 1*a* and sets the light emitting amount as 1B at a timing of displaying the input image 1*b*. Furthermore, the display apparatus sets the light emitting amount as 1A at a timing of displaying the input image 1*c*. The light emitting amount 1B is set to be larger than the light emitting amount 1A. On the other hand, to keep the luminance in the flat section as 1E, the display apparatus controls the light transmittance in accordance with the change in the light emitting amount. That is, while the light emitting amount is 1A, the transmittance is set as 1C, and at a moment when the light emitting amount becomes 1B, the transmittance is set as 1D. The transmittance 1C is set to be larger than the transmittance 1D.

A speed at which the transmittance is changed from 1C to 1D is slower than a speed at which the light emitting amount is changed from 1A to 1B. Thus, the display apparatus may not manage to interrupt the light from the light irradiation unit, and a flicker 1Ea is generated. The flicker 1Ea becomes "flicker seen bright for a moment" for viewers. Also, a speed at which the transmittance is changed from 1D to 1C is slower than a speed at which the light emitting amount is changed from 1B to 1A. The display apparatus may not increase the transmittance in accordance with a decrease in the light emitting amount and may not supply sufficient light. Thus, a flicker 1Eb is generated. Such flicker 1Eb becomes "flicker seen dark for a moment" for the viewers.

FIG. 23 illustrates a relation between the light emitting amount, the light transmittance in the flat section, and the luminance in the flat section in a case where the display apparatus displays input images 2*a* to 2*c* in the order of the input images 2*a*, 2*b*, and 2*c*. It is supposed that the input images 2*a* and 2*c* include images having a light luminance at one part, and the input image 2*b* does not include images having a high luminance. Also, a graph on the first stage from the top represents a time change in the light emitting amount with respect to the flat section, in which the vertical axis represents the light emitting amount, and the horizontal axis represents the time. A graph on the second stage from the top represents a time change in the transmittance with respect to the flat section, in which the vertical axis represents the transmittance, and the horizontal axis represents the time. A graph on the third stage from the top represents a time change in the luminance with respect to the flat section, in which the vertical axis represents the luminance, and the horizontal axis represents the time.

As illustrated in FIG. 23, the display apparatus sets the light emitting amount as 2B at a timing of displaying the input image 2*a* and sets the light emitting amount as 2A at a timing of displaying the input image 2*c*. Furthermore, the display apparatus sets the light emitting amount as 2B at a timing of displaying the input image 2*c*. On the other hand, to keep the luminance in the flat section as 2E, the display apparatus controls the light transmittance in accordance with the change in the light emitting amount. That is, while the light emitting amount is 2B, the transmittance is set as 2D, and at a moment when the light emitting amount becomes 2A, the transmittance is set as 2C.

A speed at which the transmittance is changed from 2D to 2C is slower than a speed at which the light emitting amount is changed from 2B to 2A. The display apparatus may not increase the transmittance in accordance with a decrease in the light emitting amount and may not supply sufficient light. Thus, a flicker 2Eb is generated. Also, a speed at which the transmittance is changed from 2C to 2D is slower than a speed at which the light emitting amount is changed from 2A to 2B. The display apparatus may not manage to interrupt the light from the light irradiation unit, and a flicker 2Ea is generated.

When the flickers are generated simultaneously or continuously in the flat section, the image is degraded. For example, Japanese Patent Application Publication No. 2005-258403 and Japanese Patent Application Publication No. 2006-147573 disclose technologies for dealing with slack of a response of the light control unit by imposing a limit on a change in the light amount of the light supplied by the light irradiation unit to moderate the change in the light emitting amount with respect to the time change for suppressing the flickers.

According to technologies disclosed in Japanese Patent Application Publication No. 2005-258403 and Japanese Patent Application Publication No. 2006-147573, flicker is suppressed by moderating a change in a light emitting amount with respect to a time change.

SUMMARY

According to an aspect of the invention, a display apparatus includes; an acceptance unit that accepts a first input image and a second input image; a light control unit that outputs a display image based on the first input image or the second input image; a plurality of light sources that irradiate the light control unit; a light emitting amount computation unit that computes a first light emitting amount of each of the plurality of light sources based on a luminance of the first input image and computes a tentative light emitting amount based on a luminance of the second input image of each of the plurality of light sources, based on a comparison result between the first light emitting amount and the tentative light emitting amount, imposes a limit on a change range from the first light emitting amount to a second light emitting amount of each of the plurality of light sources, and decide the second light emitting amount in a case where the second input image is displayed based on the limit; and a light source control unit that controls each of the plurality of light sources based on the second light emitting amount.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

BRIEF DESCRIPTION OF DRAWINGS

FIG. 4 illustrates exemplary data configurations of light emitting amount history data.

DESCRIPTION OF EMBODIMENTS

However, as the light emitting amount may not be changed largely while following an abrupt luminance change of an image according to technologies disclosed in Japanese Patent Application Publication No. 2005-258403 and Japanese Patent Application Publication No. 2006-147573. And a problem occurs that the input image is broken and displayed.

Furthermore, the above-mentioned flicker 2Ea becomes the "flicker seen bright for a moment" for the viewers. Also, the above-mentioned flicker 2Eb becomes the "flicker seen dark for a moment" for the viewers. Then, in a case where the "flicker seen dark for a moment" and the "flicker seen bright for a moment" exist in a mixed manner on a screen or are generated continuously in terms of time, the image is significantly degraded as compared with simple generation of the flicker. In the following description, the "flicker seen bright for a moment" is referred to as "white flicker", and the "flicker seen dark for a moment" is referred to as "black flicker".

The inventor proposes a display apparatus and a display method disclosed with which it is possible to prevent the image degradation caused by the white flicker or the black flicker.

Hereinafter, a display apparatus and a display method disclosed in the present application will be described on the basis of the drawings. It should be noted that this invention is not limited by these embodiments.

First Embodiment

Figure 1:
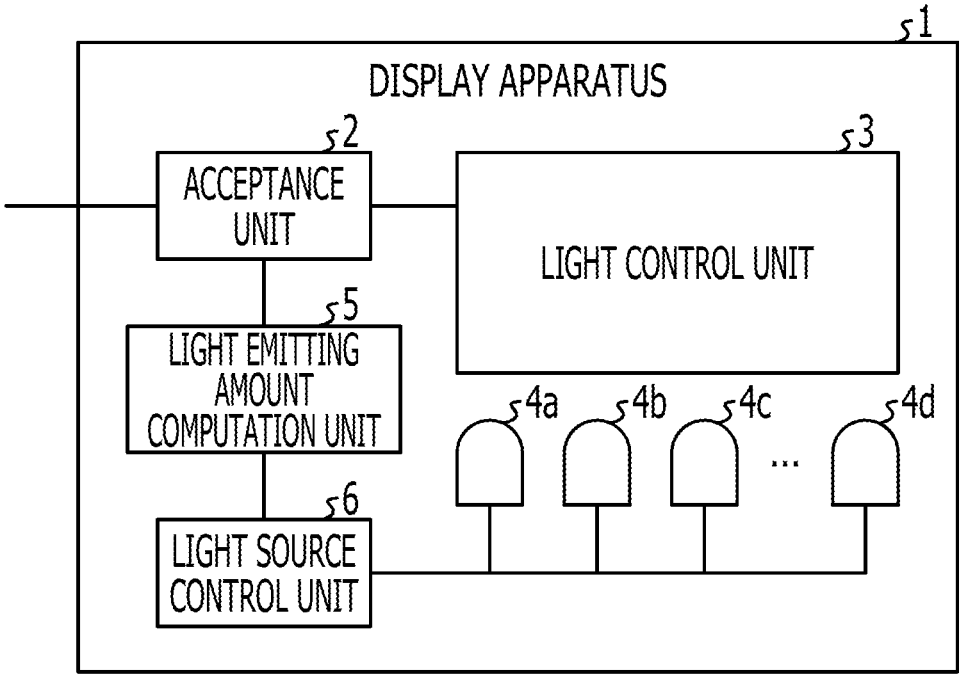
FIG. 1 is a functional block diagram illustrating a configuration of a display apparatus according to a first embodiment.

A configuration of a display apparatus according to a first embodiment will be described. FIG. 1 is a functional block diagram illustrating the configuration of the display apparatus according to the first embodiment. As illustrated in FIG. 1, this display apparatus 1 has an acceptance unit 2, a light control unit 3, light sources 4*a* to 4*d*, a light emitting amount computation unit 5, and a light source control unit 6.

The acceptance unit 2 accepts a first input image and a second input image. The light control unit 3 outputs a display image on the basis the first input image or the second input image. The light sources 4*a* to 4*d* irradiate the light control unit 3 with light.

On the basis of a luminance of the first input image, the light emitting amount computation unit 5 computes a first light emitting amount of each of the plurality of light sources 4*a* to 4*d*, and computes a tentative light emitting amount of each of the plurality of light sources 4*a* to 4*d* based on the second input image. Then, on the basis of the comparison result between the first light emitting amount and the tentative light emitting amount, the light emitting amount computation unit 5 imposes a limit on a change range from the first light emitting amount and decides a second light emitting amount of each of the plurality of light sources in a case where the second input image is displayed on this limit. On the basis of the second light emitting amount, the light source control unit 6 controls each of the plurality of light sources.

On the basis of the comparison result between the first light emitting amount and the tentative light emitting amount, the display apparatus 1 according to the first embodiment imposes the limit on the change range from the first light emitting amount and decides the second light emitting amount on the basis of this limit. By imposing the limit on the change range, it is possible to prevent the light emitting amounts of the light sources 4*a* to 4*d* from disorderly changing. Therefore, for example, by preventing change directions of the light emitting amounts of the respective light sources from being nonuniform, it is possible to prevent a situation where the white flicker and the black flicker are generated simultaneously or continuously. Then, the problem of the image degradation is eliminated.

Second Embodiment

Figure 2:
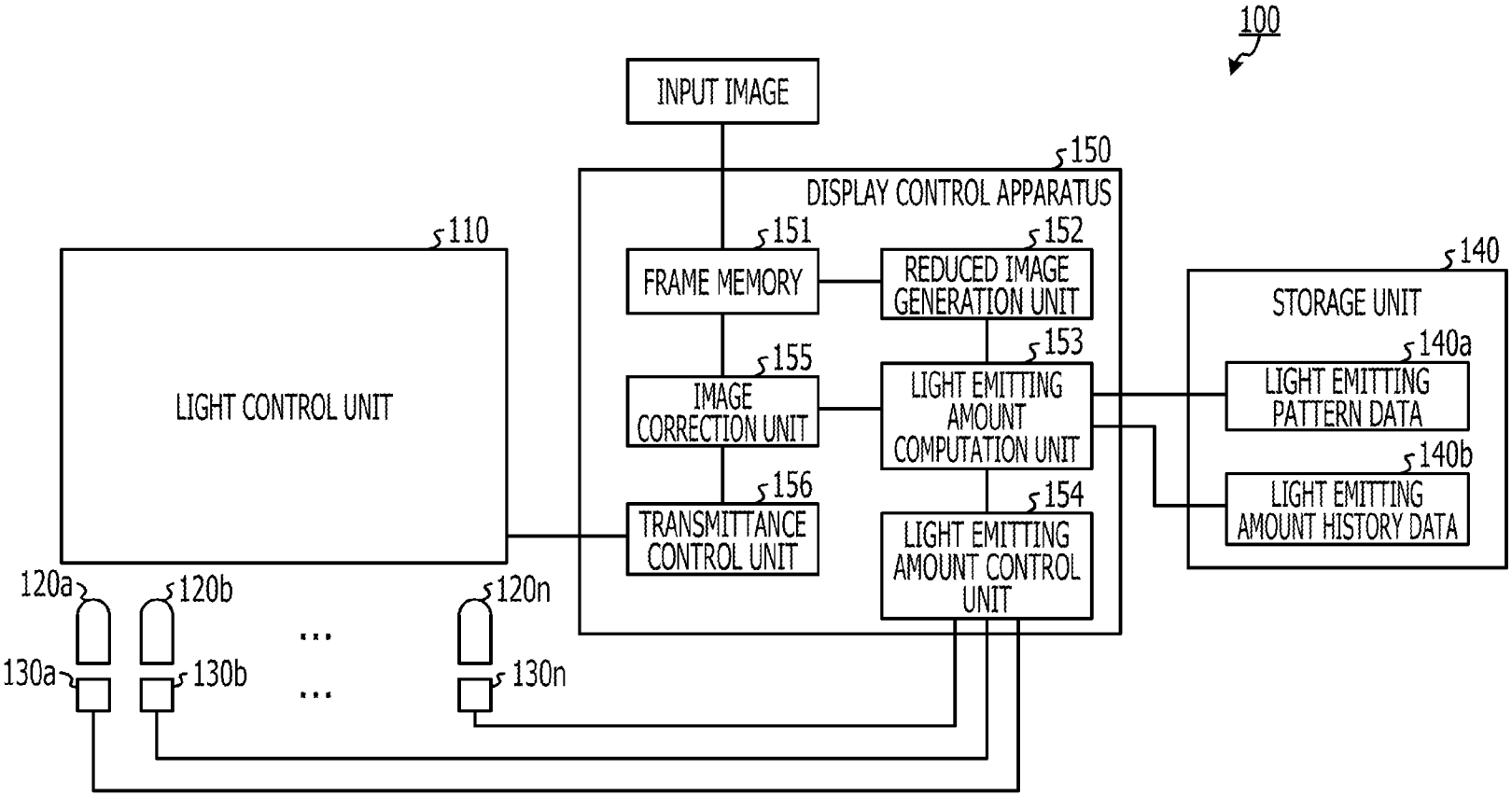
FIG. 2 is a functional block diagram illustrating a configuration of a display apparatus according to a second embodiment.

Next, a configuration of a display apparatus according to a second embodiment will be described. FIG. 2 is a functional block diagram illustrating the configuration of the display apparatus according to the second embodiment. As illustrated in FIG. 2, this display apparatus 100 has a light control unit 110, light sources 120*a* to 120*n*, drivers 130*a* to 130*n*, a storage unit 140, and a display control apparatus 150.

The light control unit 110 is, for example, a liquid crystal panel and changes a light transmittance for each pixel. The light sources 120*a* to 120*n* are, for example, LEDs (Light Emitting Diode) and supply light to the light control unit 110. The light sources 120*a* to 120*n* are arranged, for example, in line along one of sides of the light control unit 110 illustrated in FIG. 3. Herein, one of the sides of the light control unit 110 refers to a side on a bottom side in a horizontal direction of the light control unit 110 illustrated in FIG. 3. By arranging the light sources 120*a* to 120*n* in line, when a plurality of light sources emit light, it is possible to obtain a substantially uniform luminance across an entire surface of the light control unit 110. Furthermore, the number of light sources 120 and an arrangement method may be appropriately changed in accordance with part costs or the like. It should be noted that in a case where the number of light sources 120 is 12, light sources 120*a* to 120*l* exist.

On the basis of the light emitting amounts of the light sources 120 instructed by the display control apparatus 150, the drivers 130*a* to 130*n* drive the light sources 120. It should be noted that in FIG. 2, the light sources 120 and the drivers 130 are provided on a one-on-one basis, but one drive 230 may be provided to a plurality of light sources 220.

The storage unit 140 stores light emitting pattern data 140*a* and light emitting amount history data 140*b*. For example, the storage unit 140 is a RAM (Random Access Memory), a ROM (Read Only Memory), a semiconductor memory such as a flash memory, or a storage apparatus such as a hard disk or an optical disk.

Herein, the light emitting pattern data 140*a* is data on light emitting patterns formed on the light control unit 110 in a case where the light control unit 110 is irradiated with the lights at various light emitting amounts from the light source 120. For example, the light emitting pattern represents at which luminance the light is supplied to the respective points of the light control unit 110 in a case where a certain light source 120 is turned on at an intensity of 100%.

Figure 3:
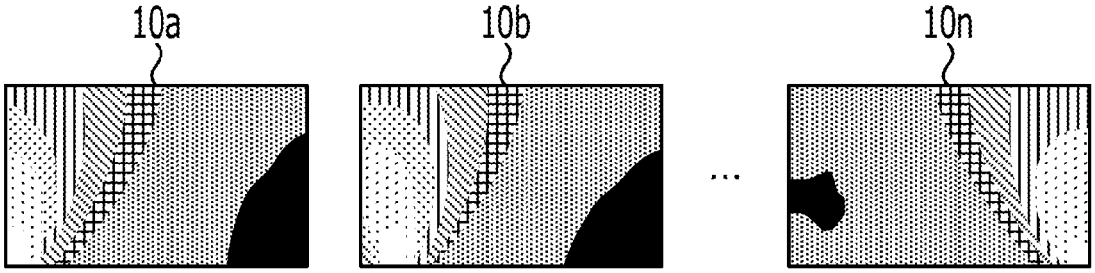
FIG. 3 illustrates exemplary light emitting patterns of respective light sources.

FIG. 3 illustrates exemplary light emitting patterns of respective light sources. For example, in a case where the light control unit 110 is irradiated with the light from the light source 120*a*, a pattern light like a light emitting pattern 10*a* is formed. This light emitting pattern 10*a* represents a distribution of the light supplied by the light source 120*a* to the light control unit 110. In the light emitting pattern 10*a*, a lower left corner of FIG. 3 where a distance between the light source 120*a* and the light control unit 110 is the closest is the brightest, and a lower right corner of FIG. 3 is the darkest.

As illustrated in FIG. 3, in a case where the light control unit 110 is irradiated with the light from the light source 120*b*, a pattern light like a light emitting pattern 10*b* is formed. This light emitting pattern 10*b* represents a distribution of the light supplied by the light source 120*b* to the light control unit 110. In this light emitting pattern 10*b*, a section on a slightly inner side from the lower left corner of FIG. 3 where a distance between the light source 120*b* and the light control unit 110 is the closest is the brightest, and the lower right corner of FIG. 3 is the darkest.

As illustrated in FIG. 3, in a case where the light control unit 110 is irradiated with the light from the light source 120*n*, a pattern like a light emitting pattern 10*n* is formed. This light emitting pattern 10*n* represents a distribution of the light supplied by the light source 120*n* to the light control unit 110. In the light emitting pattern 10*n*, the lower right corner of FIG. 3 where a distance between the light source 120*n* and the light control unit 110 is the closest is the brightest, and a section on a slightly upper side from the lower left corner of FIG. 3 is the darkest.

It should be noted that the storage unit 140 may normalize values of the light emitting pattern data so that the luminance at a point on the light control unit 110 is set as "1" when all the 12 light sources 120 emit the light at 100%.

The light emitting amount history data 140*b* stores histories of the light emitting amounts of the respective light sources 120*a* to 120*n*. FIG. 4 illustrates exemplary data configurations of the light emitting amount history data 140*b*. As illustrated in FIG. 4, this light emitting amount history data 140*b* has light source identification information for identify the light source and a light emitting amount history indicating a history of light emitting amount for each frame. In the example illustrated in FIG. 4, the light emitting amount of the light source 120*a* sequentially changes in the order of 50%, 55%, and 60%. Also, the light emitting amount of the light source 120*b* sequentially changes in the order of 50%, 50%, and 60%. Also, the light emitting amount of the light source 120 sequentially changes in the order of 50%, 50%, and 60%.

The description will be made again on FIG. 2. The display control apparatus 150 computes a transmittance of the light control unit 110 and light emitting amounts of the light sources 120 on the basis of the input image. Then, the display control apparatus 150 performs a control on the transmittance of the light control unit 110 to attain the computed transmittance. Also, the display control apparatus 150 outputs the computed light emitting amounts to the drivers 130. The display control apparatus 150 corresponds to an integrated circuit such as an ASIC (Application Specific Integrated Circuit) or an FPGA (Field Programmable Gate Array). Alternatively, the display control apparatus 150 corresponds to an electronic circuit such as a CPU (Central Processing Unit) or an MPU (Micro Processing Unit).

Herein, the display control apparatus 150 will be specifically described. As illustrated in FIG. 2, the display control apparatus 150 has a frame memory 151, a reduced image generation unit 152, a light emitting amount computation unit 153, a light emitting amount control unit 154, an image correction unit 155, and a transmittance control unit 156.

The frame memory 151 accepts an input image and stores the accepted input image. For example, a size of the input image is set as 720 in height×480 in width. Also, the input image has RGB values for each pixel.

The reduced image generation unit 152 reads the input image stored in the frame memory 151 and generates a reduced image of the read input image. It should be noted that the reduced image generation unit 152 generates the reduced image with an aim of shortening a processing time by the light emitting amount computation unit 153 which will be described below.

First, the reduced image generation unit 152 refers to the RGB (Red Green Blue) values allocated to the respective pixels of the input image to obtain a largest value among the R, G, and B values. Then, the reduced image generation unit 152 sets the obtained largest value among the R, G, and B values as a pixel value of the relevant pixel. For example, in a case where the RGB values allocated to the first pixel are respectively 250, 100, and 50, the largest value is "250". In this case, the reduced image generation unit 152 sets the pixel value of the first pixel as 250. In this manner, the reduced image generation unit 152 sets one pixel value for each pixel included in the input image.

Subsequently, the reduced image generation unit 152 thins out the image having a size of 720 in height×480 in width, for example, to generate a reduced image having a size of 90 in height×60 in width. To be more specific, in the input image, the reduced image generation unit 152 reads one line for every eight lines and performs the thinning out to read one pixel for every eight pixels. In the respective pixels of the reduced image, the above-mentioned pixel values are respectively set. It should be noted that the reduced image generation unit 152 may generate the reduced image from the input image by utilizing other methods such as bi-linear.

The light emitting amount computation unit 153 calculates the light emitting amounts of the respective light sources 120 on the basis of the light emitting pattern data 140*a*, the light emitting amount history data 140*b*, and the data on the reduced image.

First, the light emitting amount computation unit 153 sets initial values of the light emitting amounts of the respective light sources 120. For example, the light emitting amount computation unit 153 sets the light emitting amounts of the light sources 120 which are set with respect to the previous input image as initial values of the light emitting amounts of the light sources 120 with respect to the input image. In general, the previous and next images are similar to each other in many cases. For this reason, by using the light emitting amount in the previous time as the initial value of the light emitting amount in the next time, the light emitting amount computation unit 153 may promptly complete the setting on the light sources 120. Also, the light emitting amount is expected to be similar to that in the previous time, and the light emitting amount varies for each input image, and generation of the flicker or the like on the light control unit 110 may be prevented. It should be noted that in a case where the input image is the first image, a previously set light emitting amount is set as the initial value. For example, the light emitting amount 100% is set as the initial value.

Subsequently, the light emitting amount computation unit 153 divides the reduced image into a plurality areas by a straight line perpendicular to in a radiation direction of the light of the respective light sources 120. It should be noted that as the distance from the light source 120 is longer the light emitting amount computation unit 153 may widen a width of the area in the vertical direction.

Figure 5:
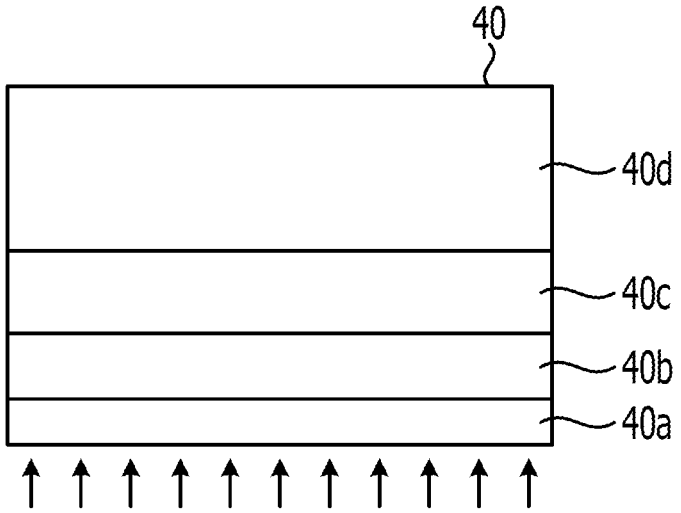
FIG. 5 is an explanatory diagram for describing a line division of a reduced image.

FIG. 5 is an explanatory diagram for describing a line division of a reduced image. The arrows illustrated in FIG. 5 represents an irradiation direction of the light source 120. As illustrated in FIG. 5, the light emitting amount computation unit 153 divides a reduced image 40 so that the width of the area in the vertical direction is widened as the distance from the light source 120 is longer. In the example illustrated in FIG. 5, the light emitting amount computation unit 153 generates by dividing the reduced image 40 as described above, areas 40*a*, 40*b*, 40*c*, and 40*d*. It should be noted that the division method illustrated in FIG. 5 is an example. For example, the light emitting amount computation unit 153 may divide the reduced image 40 so that the widths of the respective areas are even.

Next, the light emitting amount computation unit 153 generates line information for each of the areas of the divided reduced image. To be more specific, the light emitting amount computation unit 153 scans the pixel values in the area in the direction perpendicular to the arrangement direction of the light sources 120 and detects the largest pixel value among the scanned pixel values. As the light emitting amount computation unit 153 executes the above-mentioned processing for each column in the areas, line information is generated where the largest pixel value for each column in the areas is extracted. The light emitting amount computation unit 153 generates the line information for each area by performing the processing for each of the divided areas. It should be noted that in a case where the area division illustrated in FIG. 5 is not carried out, the line information becomes the pixel value itself included in the respective columns of the reduced image.

Figure 6:
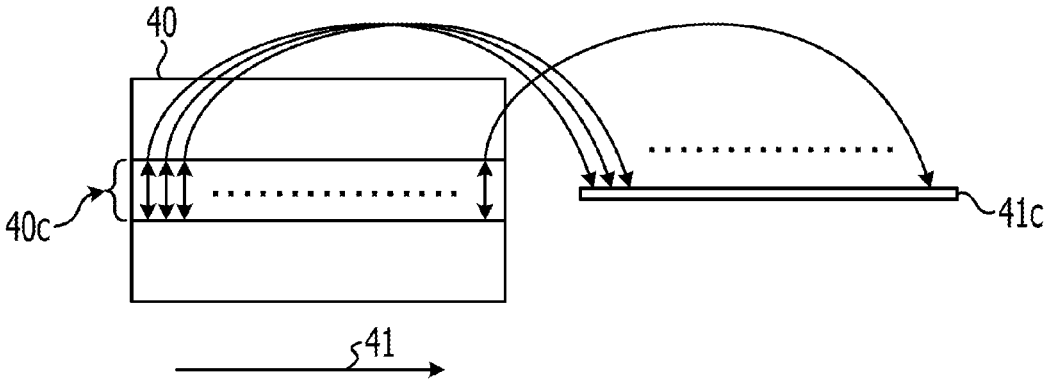
FIG. 6 is an explanatory diagram for describing a generation example of line information.

FIG. 6 is an explanatory diagram for describing a generation example of line information. In FIG. 6, a case will be described as an example in which line information 41*c* is generated with regard to the area c of the reduced image 40. The light emitting amount computation unit 153 scans the pixel value of the area c in a direction perpendicular to an arrangement direction 41 of the light sources 120 and detects the largest pixel value among the scanned pixel values. As the light emitting amount computation unit 153 executes the above-mentioned processing for each column in the area 40*c*, the line information 41*c* is generated where the largest pixel value for each column in the area 40*c* is extracted. In a case where the size of the reduced image 40 is 90 in height×60 in width, the line information has a pixel value of 60.

Subsequently, the light emitting amount computation unit 153 obtains the line information on the area closest to the light source 120 among the respective areas of the reduced image and executes the subsequent processing. Herein, a reason why the line information on the area closest to the light source 120 is selected will be described. As the distances between the respective light sources 120 and the light control unit 110 are closer, the light emitting patterns of the respective light sources 120 are sharp, and boundaries between the light emitting patterns are clarified. In contrast to this, as the distances between the respective light sources 120 and the light control unit 110 are farther, the light emitting patterns of the light sources 220 are broad, and the boundaries between the light emitting patterns are blurred.

In the area where the light emitting patterns of the respective light sources 120 are broad, even when the light emitting amount of either one of the light sources 120 is suppressed, a combined light emitting pattern corresponding to the relevant area does not change much. Herein, the combined light emitting pattern is obtained by combining the light emitting patterns of the respective light sources 120. On the other hand, in a case where the light emitting patterns of the respective light sources 120 are sharp, the combined light emitting pattern corresponding to the relevant area largely changes. For this reason, the area 40*a* at the bottom of the reduced image is a location easily subjected to an influence of the image in the light emitting amounts of the respective light sources 120, and the line information on the area 40*a* should be processed on a preferential basis.

After the line information is obtained, the light emitting amount computation unit 153 transforms the respective pixel values that the line information has into luminance equivalent values. To be more specific, the light emitting amount computation unit 153 calculates the luminance equivalent value by using the following expression (1).

$$\text{Luminance equivalent value}=(\text{pixel value}/\text{pixel largest value})\hat{}2.2 \quad (1)$$

It should be noted that the light emitting amount computation unit 153 calculates the luminance equivalent value by using the expression (1) while it is supposed that the proportional relation of the luminance ∝ (pixel value^2.2) is established. Also, in the expression (1), in the case of an image of 8 bits, the pixel largest value is 255.

After the luminance equivalent value is calculated, the light emitting amount computation unit 153 scans the luminance equivalent value in the arrangement direction of the light sources 220 to calculate the luminance distribution pattern. This luminance distribution pattern represents a distribution of the luminance equivalent values on the line information.

After the luminance distribution pattern is calculated, the light emitting amount computation unit 153 combines the light emitting patterns of the respective light sources 120 to calculate the combined light emitting pattern. In a case where the initial values of the respective light sources are set as 100%, the light emitting amount computation unit 153 takes in the light emitting pattern data 140*a* of the respective light sources 120 when the light emitting amounts of the respective light sources 120 are 100% from the storage unit to calculate the combined light emitting pattern.

After the combined light emitting pattern is calculated, the light emitting amount computation unit 153 converts the above-mentioned combined light emitting pattern in accordance with the size of the line information. For example, the pixel number of the line information is equivalent to 60 pixels, the combined light emitting pattern is converted into the combined light emitting pattern equivalent to 60 pixels. Then, the light emitting amount computation unit 153 compares the combined light emitting pattern after the conversion with the luminance distribution pattern and computes the light emitting amounts of the respective light sources 120 in accordance with the comparison result.

Figure 7:
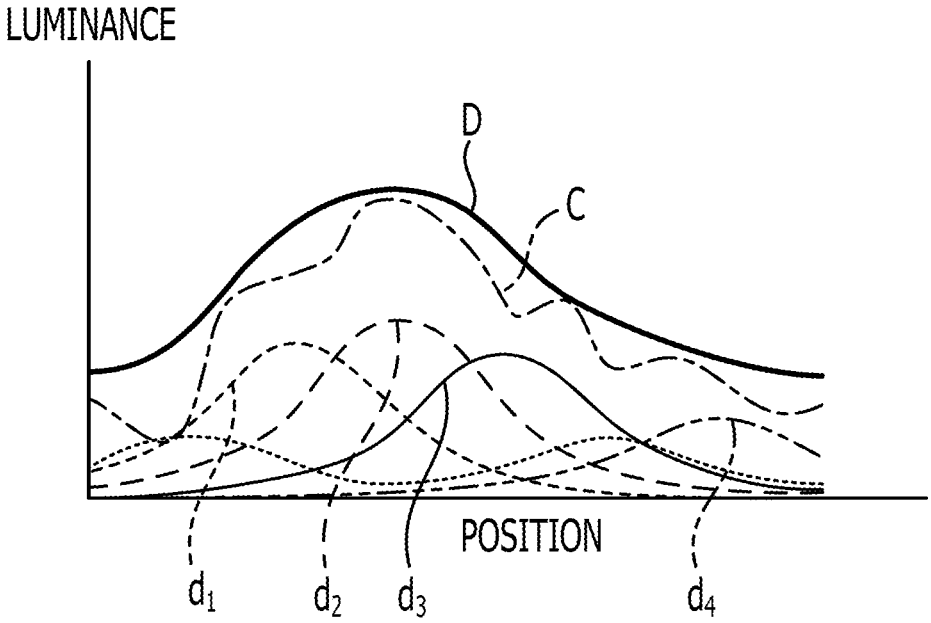
FIG. 7 illustrates a comparison example between a luminance distribution pattern and a combined light emitting pattern.

FIG. 7 illustrates a comparison example between a luminance distribution pattern and a combined light emitting pattern. The horizontal axis of FIG. 7 corresponds to the position, and the vertical axis corresponds to the luminance. Also, in FIG. 7, d1, d2, d3, d4, . . . respectively denotes light emitting patterns of the light source unit 120 that emits the light at a certain light emitting amount. A combined light emitting pattern D is obtained by combining the respective light emitting patterns d1, d2, d3, d4, . . . . C of FIG. 7 denotes a luminance distribution pattern.

The light emitting amount computation unit 153 compares the combined light emitting pattern with the luminance distribution pattern. In a case where the light emitting pattern is above the luminance distribution pattern, the light emitting amount computation unit 153 executes a decrease range adjustment processing for decreasing the light emitting amounts of the light sources 120. On the other hand, in a case where the light emitting is below the luminance distribution pattern, the light emitting amount computation unit 153 executes an increase range adjustment processing for increasing the light emitting amounts of the light sources 120. In the example illustrated in FIG. 7, as the combined light emitting pattern D is above the luminance light emitting pattern C, the light emitting amount computation unit 153 executes the decrease range adjustment processing. In the following, after the decrease range adjustment processing is described, the increase range adjustment processing will be described.

Figure 8:
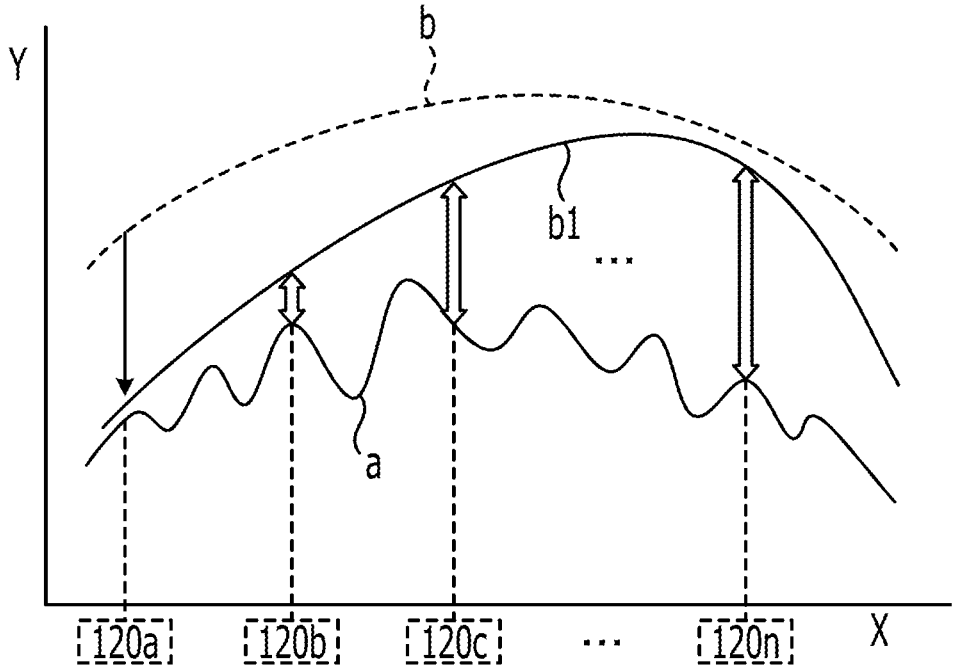
FIG. 8 is an explanatory diagram (1) for describing a decrease range adjustment processing.
Figure 9:
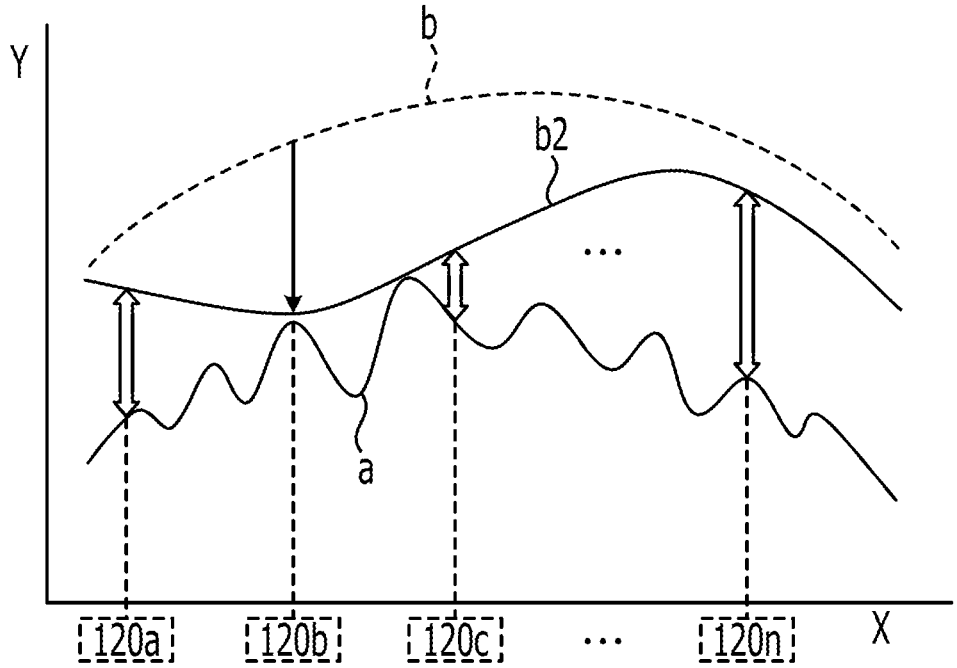
FIG. 9 is an explanatory diagram (2) for describing the decrease range adjustment processing.

FIG. 8 and FIG. 9 are explanatory diagrams for describing the decrease range adjustment processing. The vertical axis in FIG. 8 and FIG. 9 corresponds to the luminance, and the horizontal axis corresponds to the position where the light source 120*a* . . . 120*n* is arranged. As illustrated in FIG. 8, the light emitting amount computation unit 153 selects the light source 120*a* and calculates a maximum decrease range for allowing decreasing the light emitting amount of the light source 120*a* in a range where the combined light emitting pattern is above the luminance distribution pattern.

To be more specific, the light emitting amount computation unit 153 calculates the combined light emitting pattern obtained when the light emitting amount of the light source 120*a* is decreased by 10%. Then, the light emitting amount computation unit 153 compares the calculated combined light emitting pattern with the luminance distribution pattern. Then, in a case where a margin exists between the combined light emitting pattern and the luminance distribution, the light emitting amount computation unit 153 calculates the combined light emitting pattern obtained when the light emitting amount of the light source 120*a* is decreased by 5%. The light emitting amount computation unit 153 compares the calculated combined light emitting pattern with the luminance distribution pattern. Herein, the case where the margin exists between the combined light emitting pattern and the luminance distribution pattern means a state, for example, in which the combined light emitting pattern is above the luminance distribution pattern, and a margin for further decreasing the light emitting amount of the light source 120*a* exists. In this manner, the light emitting amount computation unit 153 gradually decreases the light emitting amount of the light source 120*a* and calculates a maximum decrease range for allowing decreasing the light emitting amount of the light source 120*a* in a range where the combined light emitting pattern is above the luminance distribution pattern.

It should be noted that when the light emitting amount computation unit 153 decreases the light emitting amount of the light source 120*a*, in a case where a section where the combined light emitting pattern is below the luminance distribution pattern exists, the light emitting amount computation unit 153 shifts to the maximum decrease range calculation for the next light source 120*b*. The light emitting amount computation unit 153 repeatedly performs the above-mentioned processing. It should be noted that an extent of the decreased light emitting amount of each of the other light sources 120 in a case where the light emitting amount of a certain light source 120 is decreased is set as a margin extent.

On the other hand, a case will be described in which the combined light emitting pattern is not below the luminance distribution pattern even when the light emitting amount computation unit 153 decreases the light emitting amount of the light source 120*a*. As illustrated in FIG. 8, the light emitting amount computation unit 153 creates a combined light emitting pattern b1 after the light emitting amount of the light source 120*a* is decreased in accordance with the calculated decrease range. It should be noted that the combined light emitting pattern b is a combined light emitting pattern before the light emitting amount of the light source 120*a* is decreased.

Subsequently, as illustrated in FIG. 8, the light emitting amount computation unit 153 compares the combined light emitting pattern b1 with a luminance distribution pattern a. The light emitting amount computation unit 153 calculates a margin indicating how much the light emitting amount of the light source 120*n* may be decreased from the light source 120*b*. To elaborate, the light emitting amount computation unit 153 calculates the margin extent.

It should be noted that the light emitting amount computation unit 153 may impose a limit like maximum 20% as an amount for decreasing the light emitting amount, for example. This is because if the light emitting amount is largely decreased, variation of the images displayed before and after becomes large, and a flaw such as flicker may occur.

For example, as represented by block arrows in the up and down direction in FIG. 8, the light emitting amount computation unit 153 calculates a difference between the combined light emitting pattern b1 and the luminance distribution pattern a in the areas corresponding to the arrangement positions of the light sources 120*a* to 120*n*. To elaborate, the light emitting amount computation unit 153 calculates the difference between the luminance supplied from the combined light emitting pattern and the luminance requested by the luminance distribution pattern respectively in the areas corresponding to the arrangement positions of the light sources 120*b* to 120*n*. Then, the light emitting amount computation unit 153 calculates the margin extent by adding the respective decrease ranges calculated for each light source 120.

When the calculation for the margin extent when the light emitting amount of the light source 120*a* is decreased is completed, the light emitting amount computation unit 153 executes the similar processing on the light source 120*b*. For example, as illustrated in FIG. 9, the light emitting amount computation unit 153 calculates a largest decrease range for allowing to decrease the light emitting amount of the light source 120*b* in a range in which the combined light emitting pattern b is above the luminance distribution pattern a.

It should be noted that the light emitting amount computation unit 153 does not perform the calculation for the margin extent in a case where a section in which the combined light emitting pattern becomes below the luminance distribution pattern exists when the light emitting amount of the light source 120*b* is decreased. The light emitting amount computation unit 153 shifts to the maximum decrease range computation on the next light source 120*c*.

On the other hand, a case will be described where the combined light emitting pattern is not below the luminance distribution pattern even when the light emitting amount of the light source 120*b* is decreased by the maximum decrease range. As illustrated in FIG. 9, the light emitting amount computation unit 153 creates the combined light emitting pattern b2 obtained after the light emitting amount of the light source 120*b* is decreased in accordance with the maximum decrease range. Then, the light emitting amount computation unit 153 compares the combined light emitting pattern b2 with the luminance distribution pattern a and calculates the margin extents of the respective light sources 120.

For example, as represented by block arrows in the up and down direction in FIG. 9, a difference between the combined light emitting pattern b2 and the luminance distribution pattern is calculated in the areas corresponding to the arrangement positions of the light source 120*a* and the light source 120*c* to 120*n*. To elaborate, the light emitting amount computation unit 153 calculates the difference between the luminance supplied from the combined light emitting pattern b2 and the luminance requested by the luminance distribution pattern a respectively in the areas corresponding to the arrangement positions of the light source 120*a* and the light source 120*c* to 120*n*. Then, the light emitting amount computation unit 153 calculates the margin extent indicating an extent to which the light emitting amount may be decreased by adding the respective decrease ranges calculated in the area corresponding to the arrangement positions of the light sources 120.

The light emitting amount computation unit 153 performs the calculation for the margin extent at a time when the light emitting amounts of the light source 120*a* and the light source 120*b* described above are decreased, for the entire remaining light source 120*c* to 120*n*.

Then, the light emitting amount computation unit 153 selects the light source 120 having the largest margin extent among the margin extents respectively calculated for the light source 120*a* to the light source 120*n*. Then, the light emitting amount computation unit 153 tentatively decides the light emitting amount of the selected light source 120 in accordance with the calculated decrease range. The light emitting amount computation unit 153 sets the light source 120 in which the light emitting amount is tentatively decided as selection exclusion. Then, while it is supposed that the light source 120 set as the selection exclusion emits the light at the tentatively decided light emitting amount, the light emitting amount computation unit 153 repeatedly executes the above-mentioned processing on the remaining light sources 120 that are not set as selection exclusions. In this manner, the light emitting amount computation unit 153 decreases the light emitting amount as much as possible by finding out the light source 120 having the largest margin extent.

It should be noted that to prevent generation of luminance nonuniformity or the like, a deference of the decrease ranges of the light emitting intensities between the adjacent light sources may be adjusted so as to be lower than or equal to a certain amount. Also, in a case where the image accepted by the frame memory 151 is an image having conspicuous luminance nonuniformity, the light emitting amount computation unit 153 may set the same light emitting amounts of the respective light sources. It should be noted that the image having conspicuous luminance nonuniformity is, for example, an image having an area where the pixel value is flat is wider than a certain level or the like.

On the other hand, in a case where the light source 120 that may calculate the margin extent does not exist, the light emitting amount computation unit 153 ends the decrease range adjustment processing. This is because, the state in which the light source 120 that may calculate the margin extent does not exist is the same meaning as a state in which the light source that may perform the adjustment for decreasing the light emitting amount does not exist.

For example, as illustrated in FIG. 8, in the light emitting amount computation unit 153, the margin extent calculated when the light emitting amount of the light source 120*a* is decreased to the maximum extent is supposed as the largest. In this case, the light emitting amount computation unit 153 selects the light source 120*a*. After the selection of the light source 120*a*, the light emitting amount computation unit 153 tentatively decides the light emitting amount of the light source 120*a* in accordance with the calculated maximum decrease range. For example, in a case where the maximum decrease range of the light source 120*a* is 19%, the light emitting amount computation unit 153 tentatively decides the light emitting amount of the light source 120*a* as the light emitting amount obtained by decreased the current light emitting amount by 19%.

Then, as it is supposed that the light source 120*a* emits the light at the light emitting amount of −19%, after the light source 120*a* is set as the selection exclusion, the light emitting amount computation unit 153 executes the above-mentioned processing on the remaining light sources 120*b* to 120*n* that are selection targets. In a case where the light sources 120 that are the selection targets remain, the light emitting amount computation unit 153 selects one light source 120 among the light sources 120 that are the selection targets. Then, the light emitting amount computation unit 153 executes the processing until the light sources 120 are set as the selection exclusions. On the other hand, as a result of the search, in a case where the light sources 120 that are the selection targets do not remain, the light emitting amount computation unit 153 ends the decrease range adjustment processing.

With regard to the remaining light sources 120*b* to 120*n* that are the selection targets, as a result of the execution of the above-mentioned processing, for example, in a case where the margin extent calculated when a light emitting amount of a light source 220*b* is decreased to the maximum extent is the largest, next, the light emitting amount computation unit 153 selects the light source 120*b*. After the selection of the light source 120*b*, the light emitting amount computation unit 153 tentatively decides the light emitting amount of the light source 120*b* in accordance with the calculated maximum decrease range. For example, in a case where the maximum decrease range of the light source 120*b* is 15%, the light emitting amount of the light source 120*b* is tentatively decided as the light emitting amount decreased from the current light emitting amount by 15%.

After the light source 220*b* whose light intensity is tentatively decided is set as the selection exclusion, the light emitting amount computation unit 153 executes the above-mentioned processing on the remaining light source 120*c* to 120*n* that are not set as the selection exclusions while it is supposed that the light source 120*b* emits the light at the light emitting amount of −15%.

Next, the increase range adjustment processing executed by the light emitting amount computation unit 153 will be described. As a result of the comparison between the combined light emitting pattern and the luminance distribution pattern, the light emitting amount computation unit 153 finds out a section where the light amount is most insufficient. Then, the light emitting amount computation unit 153 selects the light source 120 closest to the section as the light source of the adjustment target.

The light emitting amount computation unit 153 tentatively decides the light emitting amount obtained by adding the current light emitting amount of the light source 120 selected as the adjustment target with a certain amount. For example, the light emitting amount computation unit 153 tentatively decides the light emitting amount higher by 5% than the current light emitting amount. It should be noted that the light emitting amount computation unit 153 may set the tentatively decided light emitting amount within 120% from the current light emitting amount.

After the light emitting amounts of the light sources 120 selected as the adjustment target is tentatively decided as the certain light emitting amount, the light emitting amount computation unit 153 calculates the combined light emitting pattern in a case where the selected light source 120 is caused to emit the light at the tentatively decided light emitting amount.

Then, the light emitting amount computation unit 153 compares the calculated combined light emitting pattern with the luminance distribution pattern and determines whether the light amount insufficiency in the relevant section is eliminated. Herein, the relevant section means a section where the light amount is most insufficient as a result of the past comparison between the combined light emitting pattern and the luminance distribution pattern. In the case where the light amount insufficiency is eliminated, the light emitting amount computation unit 153 searches for a section where the light amount is most insufficient except for the section selected first from the result of the comparison between the combined light emitting pattern and the luminance distribution pattern. In the case where no section where the light amount is insufficient exists, the light emitting amount computation unit 153 ends the increase range adjustment processing.

On the other hand, in the case where another section where the light amount is insufficient exists, the light emitting amount computation unit 153 determines whether or not the light emitting amount reaches the upper limit. For example, the light emitting amount computation unit 153 imposes the upper limit of the light emitting amount as the light emitting amount higher by 20% than the current light emitting amount. In a case where the light emitting amount does not reach the upper limit, the light emitting amount computation unit 153 tentatively decides the light emitting amount obtained by further increasing the light emitting amount of the relevant light source 120. Then, similarly as in the above, the light emitting amount computation unit 153 calculates the combined light emitting pattern again and determines whether or not the light emitting amount insufficiency is eliminated.

On the other hand, in a case where the light emitting amount of the selected light source 120 reaches the upper limit, the light emitting amount computation unit 153 sets the light source 120 adjacent to the light source 120 of the selected target as a new selection target. Then, the light emitting amount computation unit 153 executes a processing similar to the above-mentioned processing on the newly selected light source 120. To elaborate, after the light emitting amount of the selected light source 120 is increased, the light emitting amount computation unit 153 compares the combined light emitting pattern with the luminance distribution pattern and determines whether or not the light emitting amount insufficiency is eliminated. It should be noted that in a case where the light emitting amount of the newly selected light source 120 reaches the upper limit, a light source adjacent to the above-mentioned light source 120 is selected, and a processing similar to the above-mentioned processing is executed.

When the decrease range adjustment processing or the increase range adjustment processing on one piece of line information is completed, the light emitting amount computation unit 153 determines whether or not the processing on all the pieces of line information is completed. In a case where all the pieces of line information is not completed, the light emitting amount computation unit 153 executes the decrease range adjustment processing or the increase range adjustment processing described above on the unprocessed line information.

On the other hand, in a case where all the pieces of line information is completed, the light emitting amount computation unit 153 compares the tentative light emitting amount calculated for each light source 120 with the light emitting amount of each light source 120 in the previous time and identifies final light emitting amounts of the respective light sources 120. The light emitting amount of each light source 120 in the previous time is stored in the light emitting amount history data 140*b*.

Herein, the change from the light emitting amounts in the previous time to the light emitting amounts in this time may be sorted into the following four patterns. (1) The light emitting amounts of all the light sources do not change as compared with those in the previous time. (2) The light emitting amounts of part of the light sources do not change as compared with those in the previous time, and the light emitting amounts of the remaining light sources increase as compared with those in the previous time. (3) The light emitting amounts of part of the light sources do not change as compared with those in the previous time, and the light emitting amounts of the remaining light sources decrease as compared with those in the previous time. (4) The light emitting amounts of part of the light sources increase as compared with those in the previous time, and the light emitting amounts of the remaining light sources decrease as compared with those in the previous time.

In a case where the change from the light emitting amounts in the previous time to the tentative light emitting amounts corresponds to the above-mentioned patterns (1) to (3), the light emitting amount computation unit 153 decides the tentative light emitting amount as the final light emitting amount. Then, the light emitting amount computation unit 153 outputs the finally decided light emitting amounts to the light emitting amount control unit 154 and the image correction unit 155 while being associated with the information on the respective light sources 120. Also, the light emitting amount computation unit 153 stores the finally decided light emitting amounts in the light emitting amount history data 140*b* while being associated with the respective light sources 120.

On the other hand, in a case where the change from the light emitting amounts in the previous time to the tentative light emitting amounts corresponds to the above-mentioned pattern (4), the light emitting amount computation unit 153 corrects values of the tentative light emitting amounts corresponding to the respective light sources 120. To be more specific, among the respective tentative light emitting amounts, the light emitting amount computation unit 153 decides the tentative light emitting amount that is increased as compared with the light emitting amount in the previous time as the final light emitting amount as it is. On the other hand, with regard to the tentative light emitting amount that is decreased as compared with the light emitting amount in the previous time, the light emitting amount computation unit 153 decides the light emitting amount in the previous time as the final light emitting amount. The light emitting amount computation unit 153 associates the finally decided light emitting amount with the information on the respective light sources 120 to be output to the light emitting amount control unit 154 and the image correction unit 155. Also, the light emitting amount computation unit 153 associates the finally decided light emitting amount with the respective light sources 120 to be stored in the light emitting amount history data 140*b*.

It should be noted that the light emitting amount computation unit 153 may decide the final light emitting amount through the following first and second methods. First, the first method will be described. The light emitting amount computation unit 153 sets an allowable range in advance. Then, the light emitting amount computation unit 153 sets the allowable range for the change amount while the most increased change amount is used as a reference among the change amounts from the light emitting amounts in the previous time to the tentative light emitting amounts.

For example, it is supposed that the allowable range is set as 15%, and the most increased change amount is set as +10%. In this case, the light emitting amount computation unit 153 sets the allowable range for the change as +10% to −5%. In a case where the change from the light emitting amount in the previous time to the tentative light emitting amount is included in +10% to −5%, the tentative light emitting amount is set as the final light emitting amount as it is. On the other hand, in a case where the change from the light emitting amounts in the previous time to the tentative light emitting amounts is not included in +10% to −5%, the tentative light emitting amount is corrected so as to be included in the allowable range, and the corrected tentative light emitting amount is decided as the final light emitting amount. For example, with regard to the tentative light emitting amount whose change from the light emitting amount in the previous time to the tentative light emitting amount is below −5%, the light emitting amount obtained by cutting −5% of the light emitting amount from the light emitting amount in the previous time is decided as the final light emitting amount.

Subsequently, the second method will be described. The light emitting amount computation unit 153 determines whether a direction of the change from the light emitting amount in the previous time to the tentative light emitting amount is on a plus side or a minus side for each light source. Then, the light emitting amount computation unit 153 imposes a limit of prohibiting the light emission at the tentative light emitting amount in the light sources whose change is sorted into the minority side among the plus side and the minus side. For example, in a case where the number of the light sources changing towards the plus side is larger than the number of the light sources changing towards the minus side, the light emitting amount computation unit 153 decides the tentative light emitting amount changing towards the plus side as the final light emitting amount as it is. On the other hand, the light emitting amount computation unit 153 limits the light emitting amount changing towards the minus side and finally decides the light emitting amount of the light source corresponding to the above-mentioned tentative light emitting amount as the light emitting amount similar to that in the previous time.

The light emitting amount control unit 154 controls the driver 130 in accordance with the light emitting amount of each of the light sources 120 by the light emitting amount computation unit 153. The light emitting amount control unit 154 outputs the light emitting amount obtained from the light emitting amount computation unit 153 to the relevant driver 130. For example, the light emitting amount control unit 154 outputs the light emitting amount of the light source 120*a* to the driver 130*a*.

The image correction unit 155 corrects the pixel value of the input image on the basis of the light emitting amount of each of the light sources 120 obtained from the light emitting amount computation unit 153. For example, the image correction unit 155 corrects the image by using the following expression (2).

$$\text{Pixel value after correction} = \text{pixel value before correction} \times (1/W)\hat{}(1/2.2) \quad (2)$$

W illustrated in the expression (2) denotes a fading rate.

The transmittance control unit 156 controls the transmittance of the light control unit 110 corresponding to the respective pixels on the basis of the respective pixels of the input image corrected by the image correction unit 155.

Figure 10:
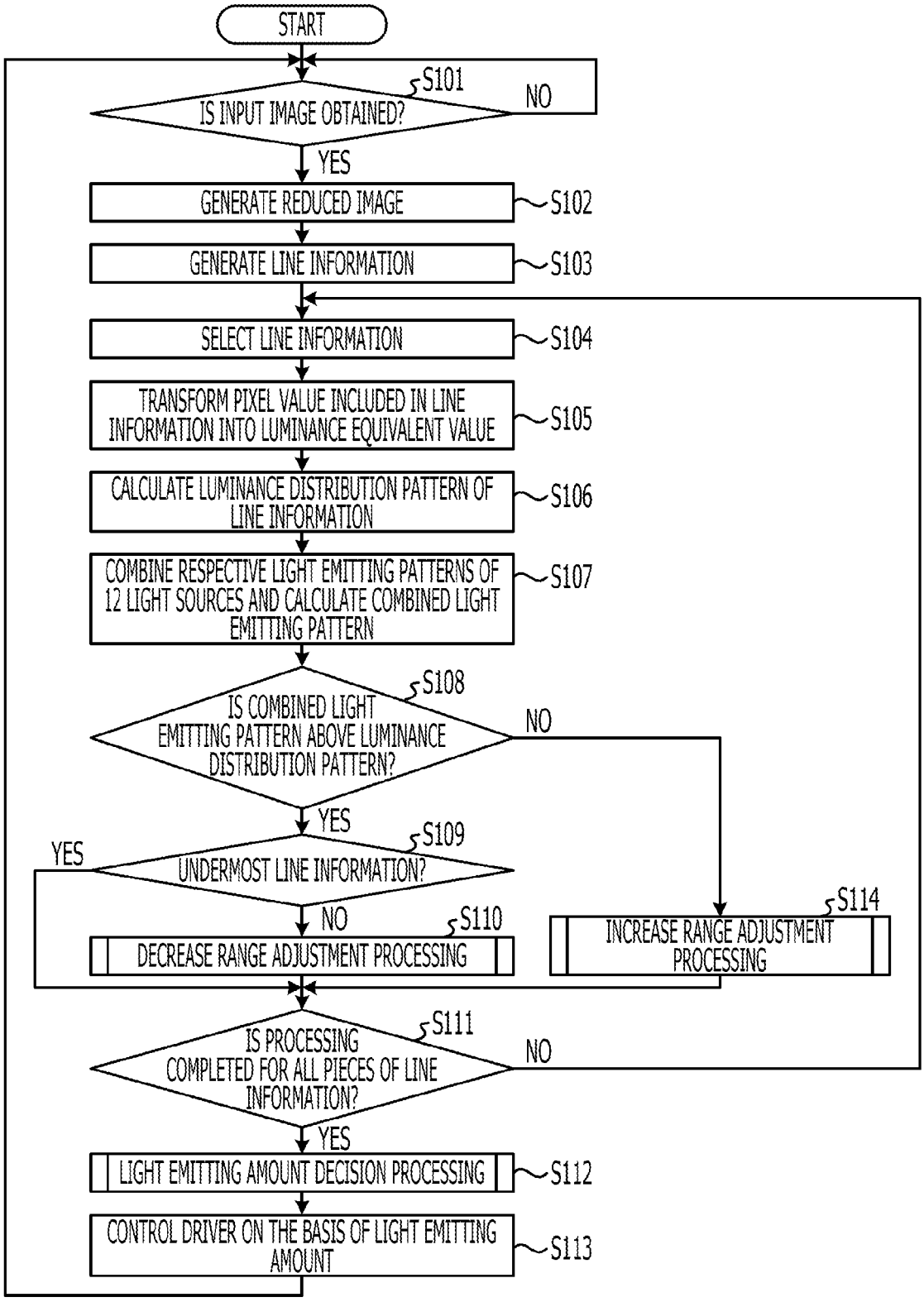
FIG. 10 is a flow chart illustrating a processing procedure by the display apparatus according to the second embodiment.

Next, a processing procedure by the display apparatus 100 according to the second embodiment will be described. FIG. 10 is a flow chart illustrating the processing procedure by the display apparatus 100 according to the second embodiment. According to the flow chart illustrated in FIG. 10, for example, the processing is started in a case where the processing is started in a case where an input image is obtained from an external apparatus. Also, it is supposed that the initial values of the light emitting amounts of the respective light sources are stored in the light emitting amount history data 140*b*. Also, in the description of FIG. 10, as an example, the number of the light sources 120 is set as 12.

As illustrated in FIG. 10, the display apparatus 100 determines whether or not the input image is obtained (S101). In a case where the input image is not obtained (S101, No), the display apparatus 100 shifts to S101 again.

In a case where the input image is obtained (S101, Yes), the display apparatus 100 generates a reduced image (S102) and generate line information (S103). The display apparatus 100 selects the line information (S104) and transforms a pixel value included in the line information into a luminance equivalent value (S105).

The display apparatus 100 calculates a luminance distribution pattern of the line information (S106) and combines the respective light emitting patterns of 12 light sources 120 to calculate a combined light emitting pattern (S107).

In a case where the combined light emitting pattern is above the luminance distribution pattern (S108, Yes), the display apparatus 100 determines whether or not this is this is the undermost line information (S109). In a case where this is the undermost line information (S109, Yes), the display apparatus 100 shifts to S111.

On the other hand, in a case where this is not the undermost line information (S109, No), the display apparatus 100 executes the decrease range adjustment processing (S110). In the case where the processing on all the pieces of line information is not completed (S111, No), the display apparatus 100 shifts to S104 again.

In the case where the processing on all the pieces of line information is completed (S111, Yes), the display apparatus 100 executes a light emitting amount decision processing (S112). The display apparatus 100 controls the driver 130 on the basis of the light emitting amount (S113) and shifts to S101 again.

Incidentally, in S108, in a case where the combined light emitting pattern is not above the luminance distribution pattern (S108, No), the display apparatus 100 executes the increase range adjustment processing (S114) and shifts to S111.

Figure 11:
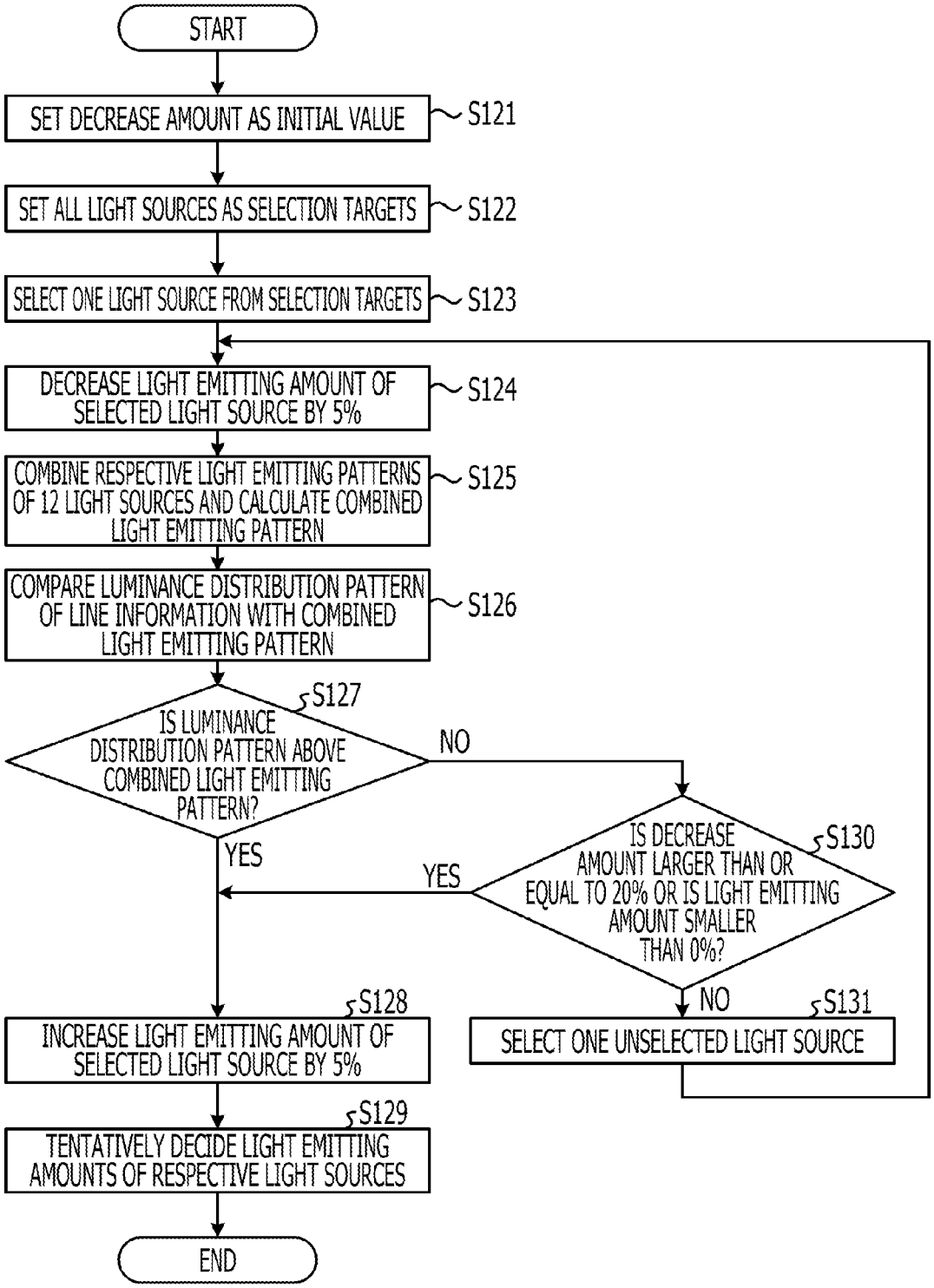
FIG. 11 is a flow chart illustrating a processing procedure of a decrease range adjustment processing according to the second embodiment.

Next, the decrease range adjustment processing illustrated in S110 of FIG. 10, the increase range adjustment processing illustrated in S114, and the light emitting amount decision processing illustrated in S112 will be sequentially described. First, the decrease range adjustment processing will be described. FIG. 11 is a flow chart illustrating a processing procedure of the decrease range adjustment processing according to the present second embodiment.

As illustrated in FIG. 11, the light emitting amount computation unit 153 sets a reduction amount as an initial value (S121) and sets all the light sources as the selection targets (S122). For example, the light emitting amount computation unit 153 sets the initial value of the reduction amount as 0.

The light emitting amount computation unit 153 select one light source of the selection target (S123) and cuts the light emitting amount of the selected light source by 5% (S124). The light emitting amount computation unit 153 combines the respective light emitting patterns of the 12 light sources and calculates the combined light emitting pattern (S125).

The light emitting amount computation unit 153 compares the luminance distribution pattern the line information with the combined light emitting pattern (S126) and determines whether or not the combined light emitting pattern is below the luminance distribution pattern (S127). In a case where the combined light emitting pattern is below the luminance distribution pattern (S127, Yes), the light emitting amount computation unit 153 increases the light emitting amount of the selected light source by 5% (S128) and tentatively decides the light emitting amounts of the respective light sources (S129). Then, the light emitting amount computation unit 153 ends the decrease range adjustment processing.

On the other hand, in a case where the combined light emitting pattern is not below the luminance distribution pattern (S127, No), the light emitting amount computation unit 153 determines whether or not the reduction amount is larger than or equal to 20% or the light emitting amount is smaller than 0% (S130).

In a case where the condition in S130 is satisfied (S130, Yes), the light emitting amount computation unit 153 shifts to S128. On the other hand, in a case where the condition in S130 is not satisfied (S130, No), the light emitting amount computation unit 153 selects one of the unselected light sources (S131) and shifts to S124 again. It should be noted that the light emitting amount computation unit 153 may calculate the above-mentioned margin extent for each light source and utilize the relevant margin extent to select the unselected light source.

Figure 12:
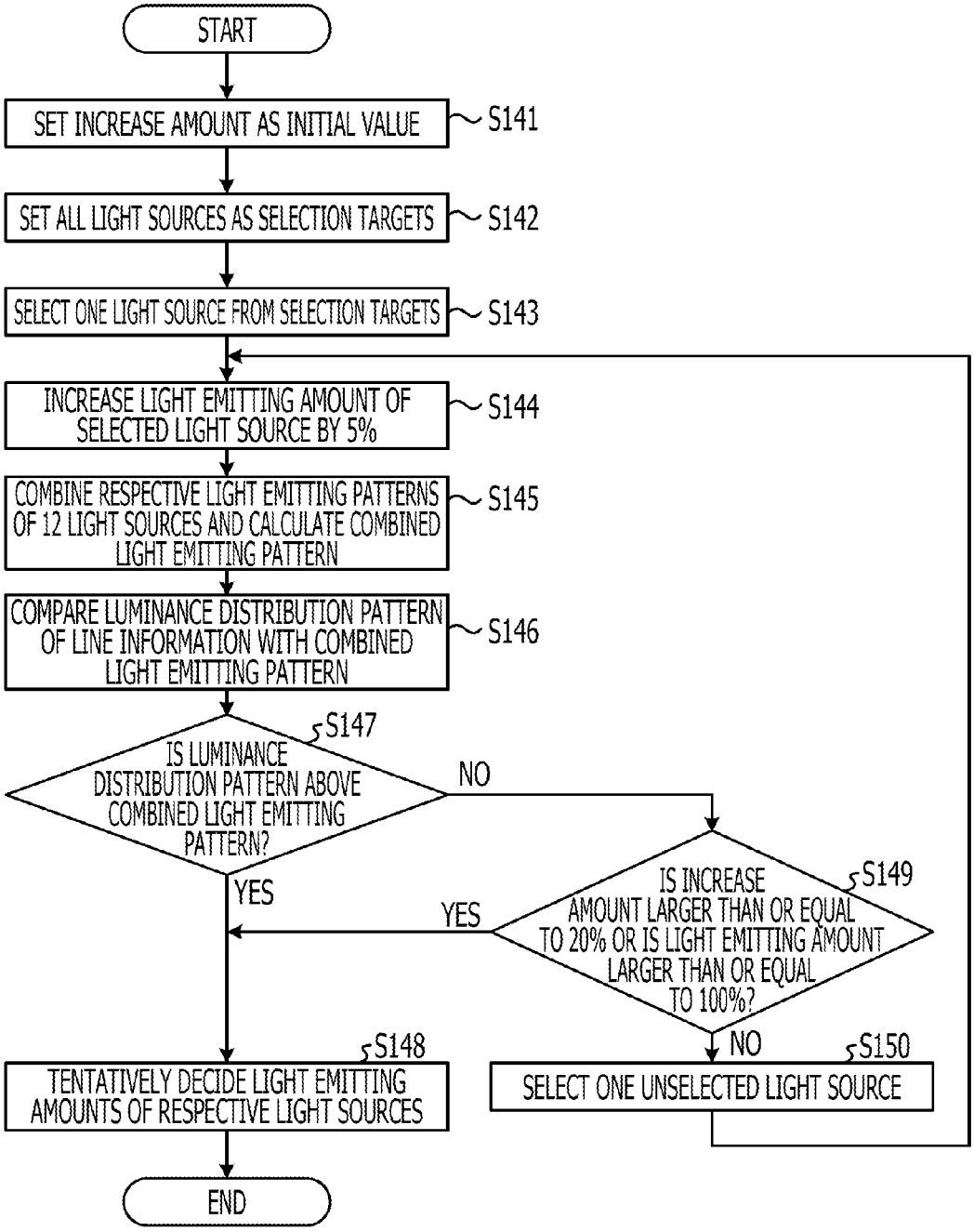
FIG. 12 is a flow chart illustrating a processing procedure of an increase range adjustment processing according to the second embodiment.

Next, the increase range adjustment processing will be described. FIG. 12 is a flow chart illustrating a processing procedure of the increase range adjustment processing according to the present second embodiment. As illustrated in FIG. 12, the light emitting amount computation unit 153 sets the increased amount as an initial value (S141) and sets all the light sources as the selection targets (S142). For example, the light emitting amount computation unit 153 sets the initial value of the increased amount as 0.

The light emitting amount computation unit 153 select one light source of the selection target (S143) and increases the light emitting amount of the selected light source by 5% (S144). The light emitting amount computation unit 153 combines the respective light emitting patterns of the 12 light sources and calculates the combined light emitting pattern (S145).

The light emitting amount computation unit 153 compares the luminance distribution pattern the line information with the combined light emitting pattern (S146) and determines whether or not the combined light emitting pattern is above the luminance distribution pattern (S147). In a case where the combined light emitting pattern is above the luminance distribution pattern (S147, Yes), the light emitting amounts of the respective light sources is tentatively decided (S148). Then, the light emitting amount computation unit 153 ends the increase range adjustment processing.

On the other hand, in a case where the combined light emitting pattern is not above the luminance distribution pattern (S147, No), the light emitting amount computation unit 153 determines whether or not the increased amount is larger than or equal to 20% or the light emitting amount is larger or equal to 100% (S149).

In a case where the condition in S149 is satisfied (S149, Yes), the light emitting amount computation unit 153 shifts to S148. On the other hand, in a case where the condition in S149 is not satisfied (S149, No), the light emitting amount computation unit 153 selects one of the unselected light sources (S150) and shifts to S144 again.

Figure 13:
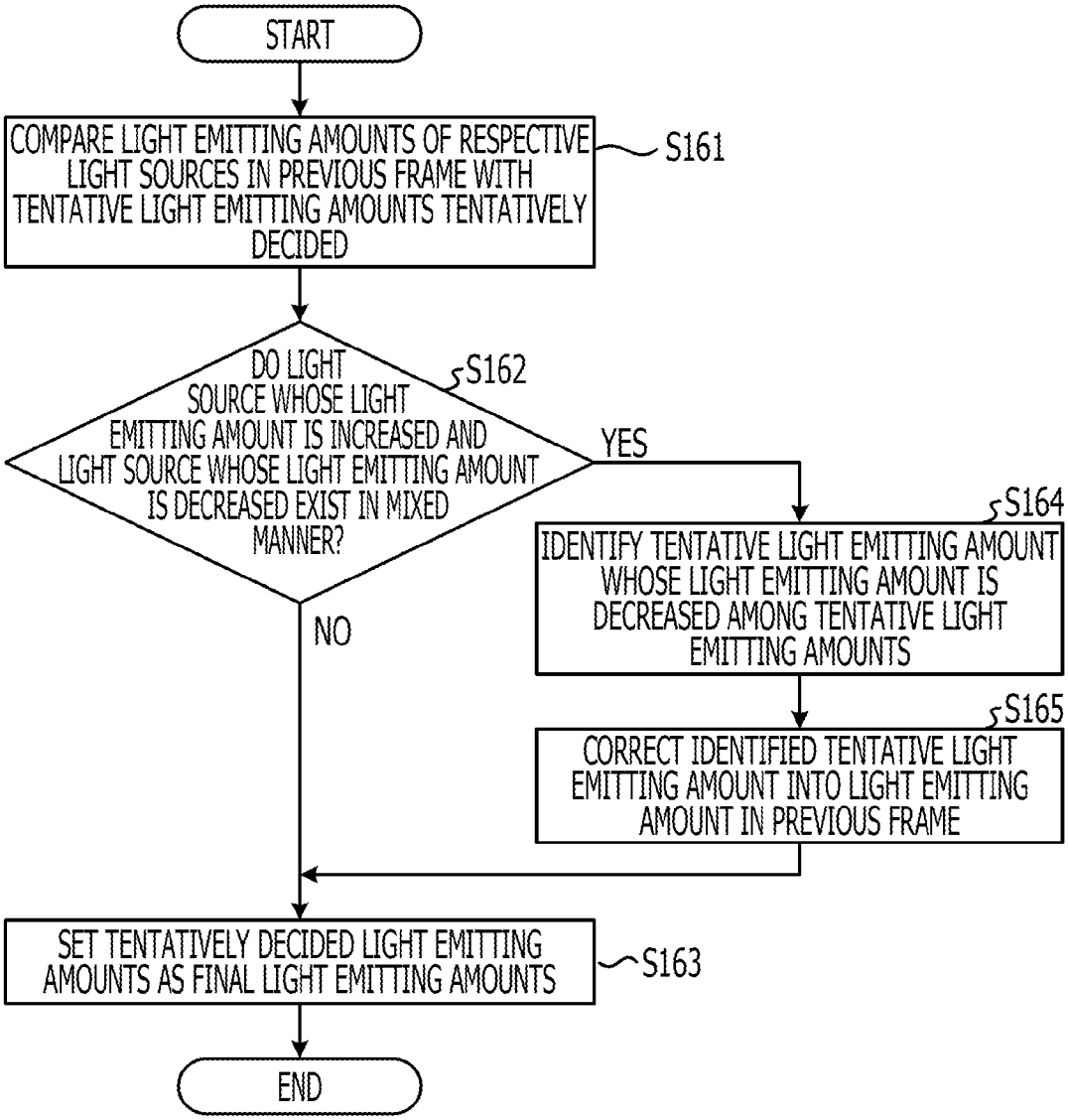
FIG. 13 is a flow chart illustrating a processing procedure of a light emitting amount decision processing according to the second embodiment.

Next, the light emitting amount decision processing will be described. FIG. 13 is a flow chart illustrating a processing procedure of a light emitting amount decision processing according to the second embodiment. As illustrated in FIG. 13, the light emitting amount computation unit 153 compares the light emitting amounts of the respective light sources in the previous frame with the tentatively decided tentative light emitting amount (S161).

The light emitting amount computation unit 153 determines whether or not the light source whose light emitting amount is increased and the light source whose light emitting amount is decreased exist in a mixed manner as compared with the light emitting amount in the previous time (S162). In a case where the light source whose light emitting amount is increased and the light source whose light emitting amount is decreased do not exist in a mixed manner (S162, No), the light emitting amount computation unit 153 sets the tentatively decided light emitting amount as the final light emitting amount (S163). Then, the light emitting amount computation unit 153 ends the light emitting amount decision processing.

On the other hand, in a case where the light source whose light emitting amount is increased and the light source whose light emitting amount is decreased exist in a mixed manner (S162, Yes), the light emitting amount computation unit 153 identifies the tentative light emitting amount whose light emitting amount is decreased among the tentative light emitting amounts (S164). Then, the light emitting amount computation unit 153 corrects the identified tentative light emitting amount into the light emitting amount in the previous frame (S165) and shifts to S163.

For each light source 120, on the basis of the comparison result between the respective light emitting amounts in the previous time and the respective tentative light emitting amounts, the display apparatus 100 according to the present second embodiment imposes a limit on the direction of the change from the light emitting amount in the previous time. Then, on the basis of this limit, the display apparatus 100 finally decides the light emitting amount in this time. For example, in a case where the directions of the changes of the respective light emitting amounts in the previous time and the respective tentative light emitting amounts are different in a plurality of light sources, the display apparatus 100 adopts only the tentative light emitting amount changing towards the bright direction as the final light emitting amount. Then, the display apparatus 100 sets the other light emitting amounts as the light emitting amount that is the same as the light emitting amount in the previous time. In this way, as the display apparatus 100 adjusts the final light emitting amount, the state is prevented in which the area where the luminance is changed to be bright and the area where the luminance is changed to be dark exist in a mixed manner on the same screen. To elaborate, the display apparatus 100 may prevent the image quality degradation caused by the simultaneous generation of the white flicker and the black flicker on the same screen.

Third Embodiment

Figure 14:
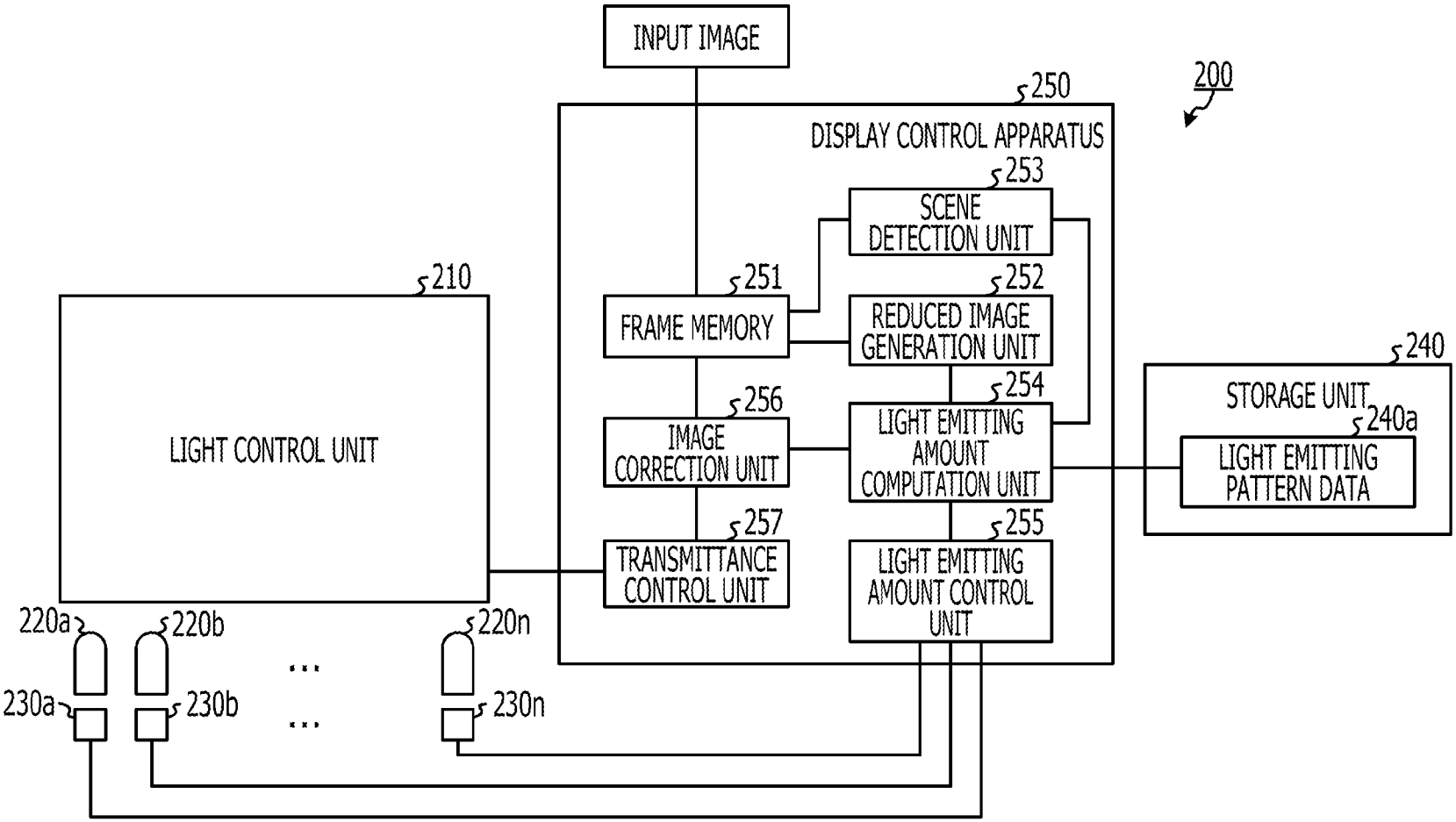
FIG. 14 is a functional block diagram illustrating a configuration of a display apparatus according to a third embodiment.

Next, a display apparatus according to a third embodiment will be described. FIG. 14 is a functional block diagram illustrating a configuration of the display apparatus according to the third embodiment. As illustrated in FIG. 14, this display apparatus 200 has a light control unit 210, the light sources 220*a* to 220*n*, drivers 230*a* to 230*n*, a storage unit 240, and a display control apparatus 250.

Among these, a description related to the light control unit 210, the light sources 220*a* to 220*n*, and the drivers 230*a* to 230*n* is similar to the description related to the light control unit 110, the light source 120*a* to 220*n*, and the drivers 130*a* to 130*n* described according to the above-mentioned second embodiment. For this reason, the description related to the light control unit 210, the light sources 220*a* to 220*n*, and the drivers 230*a* to 230*n* will be omitted.

The storage unit 240 stores light emitting pattern data 240*a*. The storage unit 240 is a RAM, a ROM, a semiconductor memory element such as a flash memory, or a storage apparatus such as a hard disk or an optical disk. A description related to the light emitting pattern data 240*a* is similar to the description related to the light emitting pattern data 140*a* described according to the second embodiment.

The display control apparatus 250 computes the transmittance of the light control unit 210 and the light emitting amount of the light source 220 on the basis of the input image. Then, the display control apparatus 250 controls the transmittance of the light control unit 210 so as to have the computed transmittance. Also, the display control apparatus 250 controls the driver 230 so as to have the computed light emitting amount. The display control apparatus 250 corresponds to an integrated circuit such as an ASIC or an FPGA. Alternatively, the display control apparatus 250 corresponds to an electronic circuit such as a CPU or an MPU.

Herein, the display control apparatus 250 will be specifically described. As illustrated in FIG. 14, the display control apparatus 250 has a frame memory 251, a reduced image generation unit 252, a scene detection unit 253, a light emitting amount computation unit 254, a light emitting amount control unit 255, an image correction unit 256, and a transmittance control unit 257.

Among these, a description related to the frame memory 251, the reduced image generation unit 252, and the light emitting amount control unit 255 is similar to the description related to the frame memory 151, the reduced image generation unit 152, and the light emitting amount control unit 154 described according to the above-mentioned second embodiment. Also, a description related to the image correction unit 256 and the transmittance control unit 257 is similar to the description related to the image correction unit 155 and the transmittance control unit 156 described according to the above-mentioned second embodiment.

The scene detection unit 253 determines whether or not the video is changed to be bright and outputs a determination result to the light emitting amount computation unit 254. For example, the scene detection unit 253 detects changes in highlight pixel values of the previous and next input images stored in the frame memory 251. Then, the scene detection unit 253 determines that the video is changed to be bright in a case where the change in the highlight pixel value is larger than or equal to a threshold. Herein, the highlight corresponds to an area where the pixel value becomes the largest in the input image.

It should be noted that the scene detection unit 253 may divide the previous and next input images and determine whether or not the video is changed to be bright on the basis of the changes in highlight pixel values of the divided respective areas. For example, the scene detection unit 253 divides the previous and next input images into two including the right side and the left side. Then, the scene detection unit 253 determines that the video is changed to be bright in a case where the change in the highlight pixel value on the right side and the change in the highlight pixel value the left side are both larger than or equal to the threshold.

The light emitting amount computation unit 254 calculates the light emitting amounts of the respective light sources 220 on the basis of the light emitting pattern data 240*a*, the data on the reduced image, and the determination result of the scene detection unit 253. The light emitting amount computation unit 254 outputs the light emitting amounts of the respective light sources 220 to the light emitting amount control unit 255. In the following, the processing by the light emitting amount computation unit 254 will be described while separating the cases where the scene detection unit 253 determines that the video is changed to be bright and where the scene detection unit 253 determines that the video is not changed to be bright.

First, the processing by the light emitting amount computation unit 254 in a case where the scene detection unit 253 determines that the video is changed to be bright will be described. In this case, the light emitting amount computation unit 254 only executes the increase range adjustment processing and skips the decrease range adjustment processing. The processing related to the increase range adjustment processing is similar to the increase range adjustment processing described according to the above-mentioned second embodiment. It should be noted that the light emitting amount computation unit 254 decides the tentatively decided tentative light emitting amount, as the actual light emitting amount as it is in the increase range adjustment processing. In this way, the light emitting amount computation unit 254 may set the light emitting amount so that all the light sources are not changed to be dark by skipping the decrease range adjustment processing in a case where the scene will be bright later. For this reason, it is possible to prevent the simultaneous generation of the white flicker and the black flicker.

Subsequently, the processing by the light emitting amount computation unit 254 in a case where the scene detection unit 253 determines that the video is not changed to be bright will be described. In this case, similarly as in the second embodiment, the light emitting amount computation unit 254 executes the increase range adjustment processing and the decrease range adjustment processing. It should be noted that the light emitting amount computation unit 254 decides the tentatively decided tentative light emitting amount, as the actual light emitting amount as it is in the increase range adjustment processing or the decrease range adjustment processing.

Figure 15:
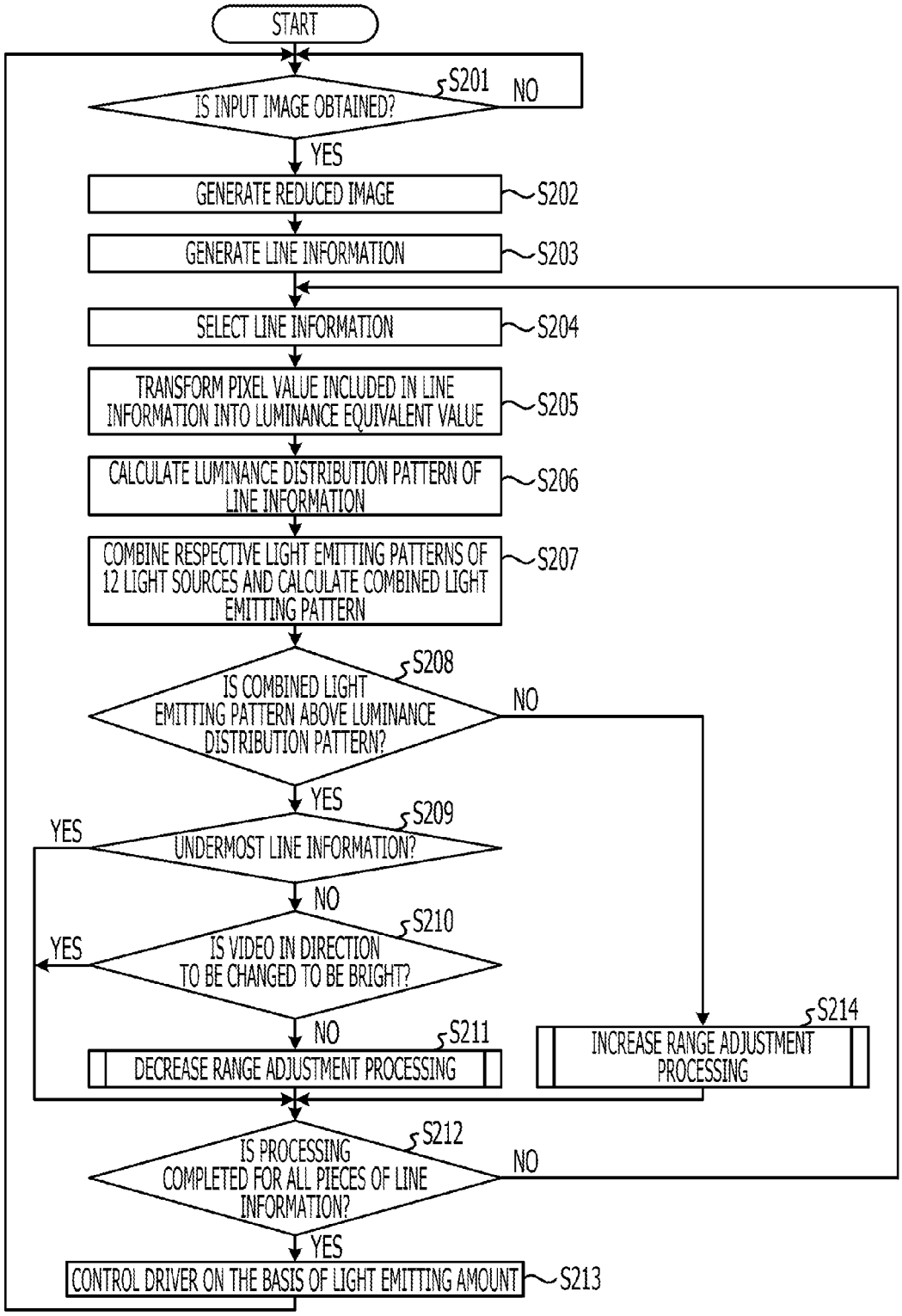
FIG. 15 is a flow chart illustrating a processing procedure by the display apparatus according to the third embodiment.

Next, a processing procedure by the display apparatus 200 according to the third embodiment will be described. FIG. 15 is a flow chart illustrating the processing procedure by the display apparatus 200 according to the third embodiment. According to the flow chart illustrated in FIG. 15, for example, the processing is started in a case where the input image is obtained from the external apparatus. Also, it is supposed that the initial values of the light emitting amounts of the respective light sources are previously set for each of the light sources 220.

As illustrated in FIG. 15, this display apparatus 200 determines whether or not the input image is obtained (S201). In a case where the input image is not obtained (S201, No), this display apparatus 200 shifts to S201 again.

In a case where the input image is obtained (S201, Yes), this display apparatus 200 generates a reduced image (S202) and generate line information (S203). This display apparatus 200 selects the line information (S204) and transforms a pixel value included in the line information into a luminance equivalent value (S205).

This display apparatus 200 calculates a luminance distribution pattern of the line information (S206) and combines the respective light emitting patterns of the 12 light sources 220 to calculate the combined light emitting pattern (S207).

In a case where the combined light emitting pattern is above the luminance distribution pattern (S208, Yes), this display apparatus 200 determines whether or not this is the undermost line information (S209). In a case where this is the undermost line information (S209, Yes), this display apparatus 200 shifts to S212.

On the other hand, in a case where this is not the undermost line information (S209, No), this display apparatus 200 determines whether or not the video is in the direction to be changed to be bright (S210). This is the direction where the video is in the direction to be changed to be bright (S210, Yes), this display apparatus 200 shifts to S212.

On the other hand, the video is in the direction to be changed to be bright (S210, No), this display apparatus 200 executes the decrease range adjustment processing (S211). In the case where the processing on all the pieces of line information is not completed (S212, No), this display apparatus 200 shifts to S204 again.

In the case where the processing on all the pieces of line information is completed (S212, Yes), this display apparatus 200 controls the driver 130 on the basis of the light emitting amount (S213) and shifts to S201 again.

Incidentally, in S208, in a case where the combined light emitting pattern is not above the luminance distribution pattern (S208, No), this display apparatus 200 executes the increase range adjustment processing (S214) and shifts to S212.

Figure 16:
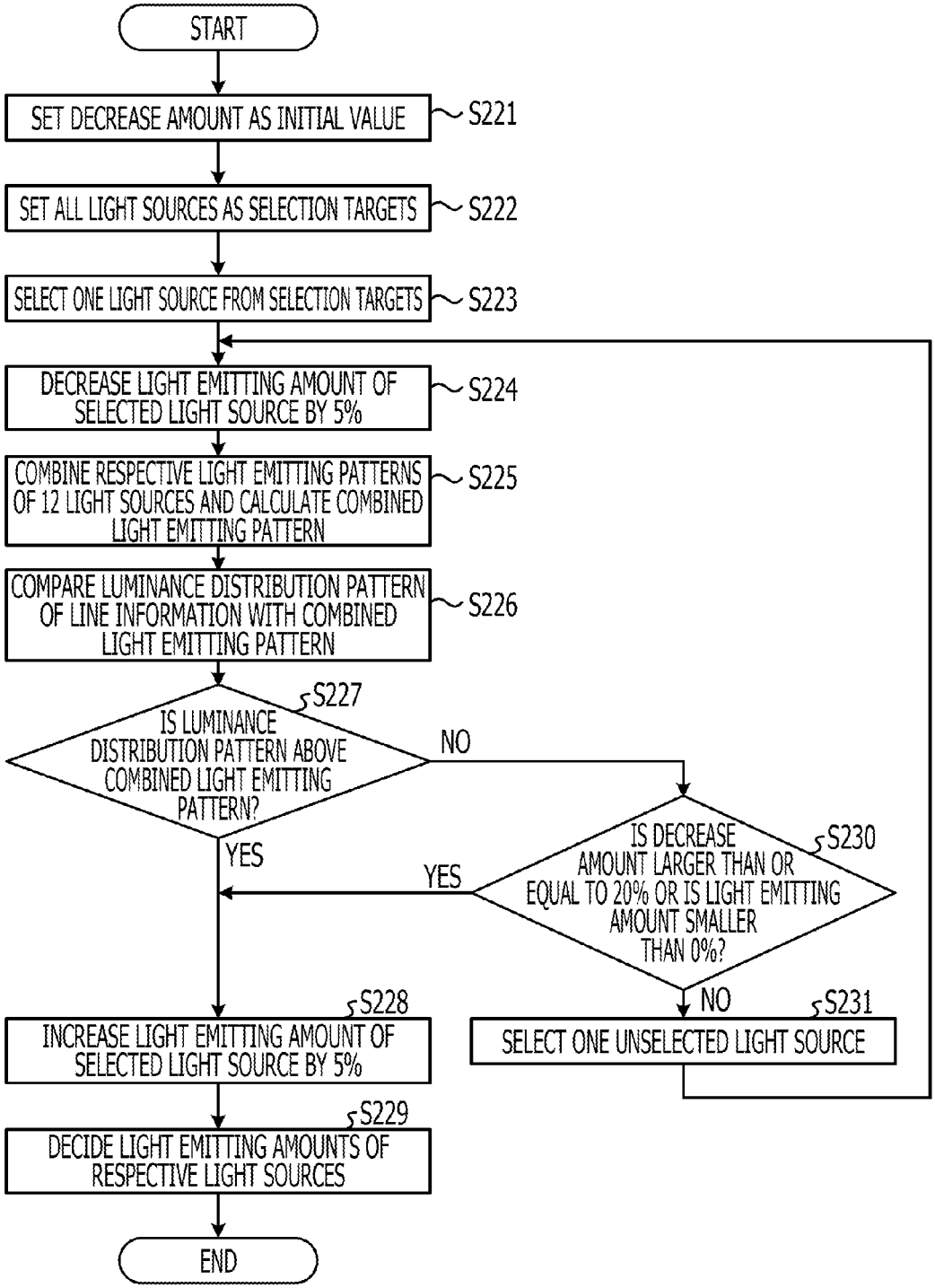
FIG. 16 is a flow chart illustrating a processing procedure of a decrease range adjustment processing according to the third embodiment.

Next, the decrease range adjustment processing illustrated in S212 of FIG. 15 and the increase range adjustment processing illustrated in S214 will be sequentially described. First, the decrease range adjustment processing will be described. FIG. 16 is a flow chart illustrating a processing procedure of the decrease range adjustment processing according to the third embodiment.

As illustrated in FIG. 16, the light emitting amount computation unit 254 sets the reduction amount as the initial value (S221) and sets all the light sources as the selection targets (S222). For example, the light emitting amount computation unit 254 sets the initial value of the reduction amount as 0.

The light emitting amount computation unit 254 select one light source of the selection target (S223) and cuts the light emitting amount of the selected light source by 5% (S224). The light emitting amount computation unit 254 combines the respective light emitting patterns of the 12 light sources and calculates the combined light emitting pattern (S225).

The light emitting amount computation unit 254 compares the luminance distribution pattern the line information with the combined light emitting pattern (S226) and determines whether or not the combined light emitting pattern is below the luminance distribution pattern (S227). In a case where the combined light emitting pattern is below the luminance distribution pattern (S227, Yes), the light emitting amount computation unit 254 increases the light emitting amount of the selected light source by 5% (S228) and decides the light emitting amounts of the respective light sources (S229).

On the other hand, in a case where the combined light emitting pattern is not below the luminance distribution pattern (S227, No), the light emitting amount computation unit 254 determines whether or not the reduction amount is larger than or equal to 20% or the light emitting amount is smaller than 0% (S230).

In a case where the condition in S230 is satisfied (S230, Yes), the light emitting amount computation unit 254 shifts to S228. On the other hand, in a case where the condition in S230 is not satisfied (S230, No), the light emitting amount computation unit 254 selects one of the unselected light sources (S231) and shifts to S224 again.

Figure 17:
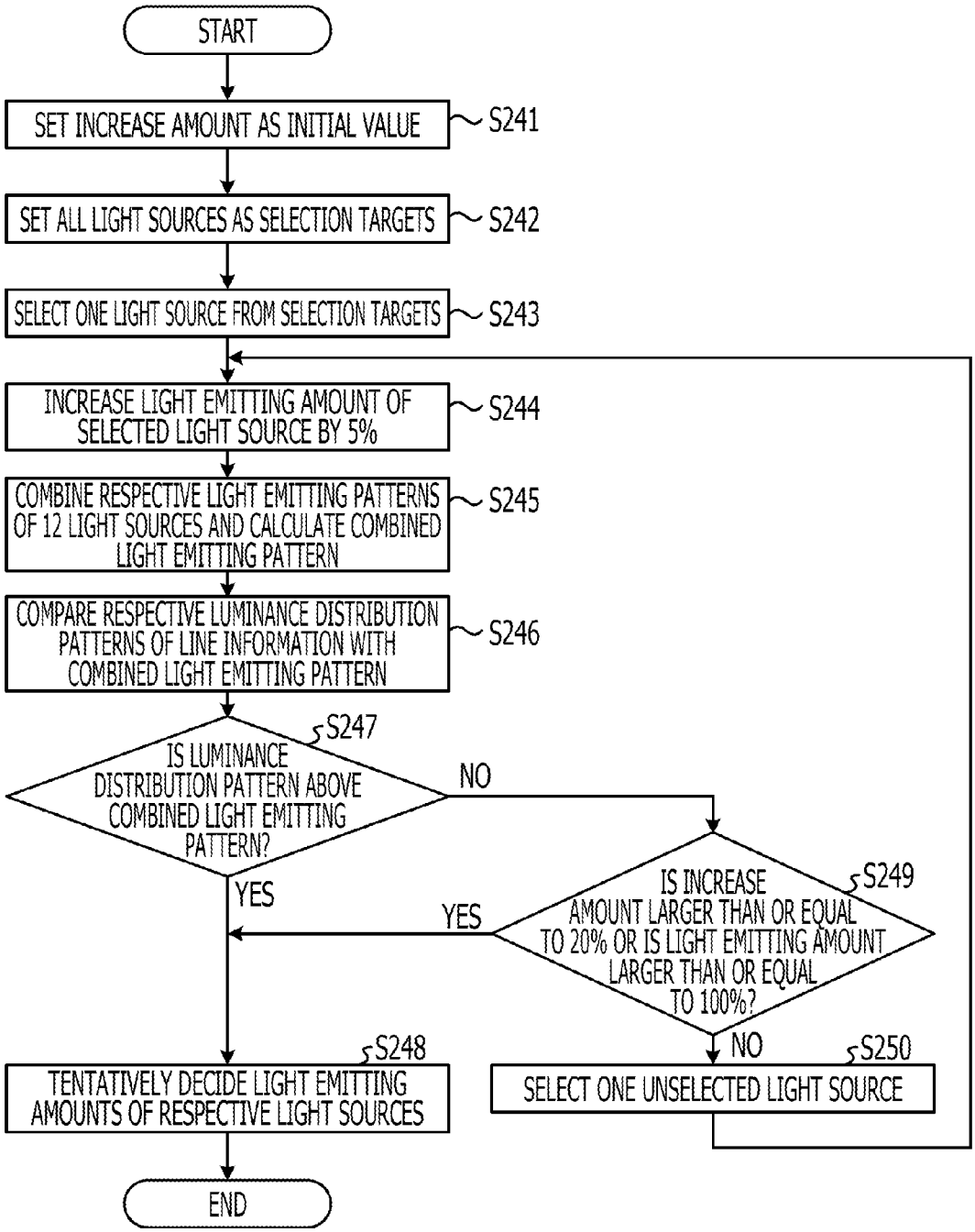
FIG. 17 is a flow chart illustrating a processing procedure of an increase range adjustment processing according to the second embodiment.

Next, the increase range adjustment processing illustrated in S214 of FIG. 15 will be described. FIG. 17 is a flow chart illustrating a processing procedure of the increase range adjustment processing according to the present third embodiment. As illustrated in FIG. 17, the light emitting amount computation unit 254 sets the increased amount as an initial value (S241) and sets all the light sources as the selection targets (S242). For example, the light emitting amount computation unit 254 sets the initial value of the increased amount as 0.

The light emitting amount computation unit 254 select one light source of the selection target (S243) and increases the light emitting amount of the selected light source by 5% (S244). The light emitting amount computation unit 254 combines the respective light emitting patterns of the 12 light sources and calculates the combined light emitting pattern (S245).

The light emitting amount computation unit 254 compares the luminance distribution pattern the line information with the combined light emitting pattern (S246) and determines whether or not the combined light emitting pattern is above the luminance distribution pattern (S247). In a case where the combined light emitting pattern is above the luminance distribution pattern (S247, Yes), the light emitting amounts of the respective light sources are decided (S248). Then, the light emitting amount computation unit 254 ends the increase range adjustment processing.

On the other hand, in a case where the combined light emitting pattern is not above the luminance distribution pattern (S247, No), the light emitting amount computation unit 254 determines whether or not the increased amount is larger than or equal to 20% or the light emitting amount is larger or equal to 100% (S249).

In a case where the condition in S249 is satisfied (S249, Yes), the light emitting amount computation unit 254 shifts to S248. On the other hand, in a case where the condition in S249 is not satisfied (S249, No), the light emitting amount computation unit 254 selects one of the unselected light sources (S250) and shifts to S244 again.

In a case where it is determined that the video is changed to be bright, this display apparatus 200 according to the present third embodiment skips the decrease range adjustment processing and executes only the increase range adjustment processing. For this reason, in a case where the video is changed to be bright, the light emitting amount only changes towards the plus direction. For this reason, this display apparatus 200 may prevent the state in which the area where the luminance is changed to be bright and the area where the luminance is changed to be dark exist in a mixed manner on the same screen. To elaborate, this display apparatus 200 may prevent the simultaneous generation of the white flicker and the black flicker.

Also, as the tentative light emitting amount is identified as the actual light emitting amount as it is, this display apparatus 200 according to the present third embodiment may not perform the processing of determining whether or not the tentative light emitting amount is adopted. For this reason, it is possible to promptly decide the light emitting amount.

It should be noted that according to the present third embodiment, in a case where the video is changed to be bright, the light emitting amount computation unit 254 skips the decrease range adjustment processing, but the configuration is not limited to this. For example, the light emitting amount computation unit 254 may set the change range of the light emitting amount of the decrease range adjustment processing to be smaller as compared with the change range of the light emitting amount of the increase range adjustment processing. For example, the light emitting amount computation unit 254 allows the increased amount of the light emitting amount at up to +30% in the increase range adjustment processing. In contrast to this, in the decrease range adjustment processing, the reduction amount of the light emitting amount may be allowed at up to −5%.

Fourth Embodiment

Figure 18:
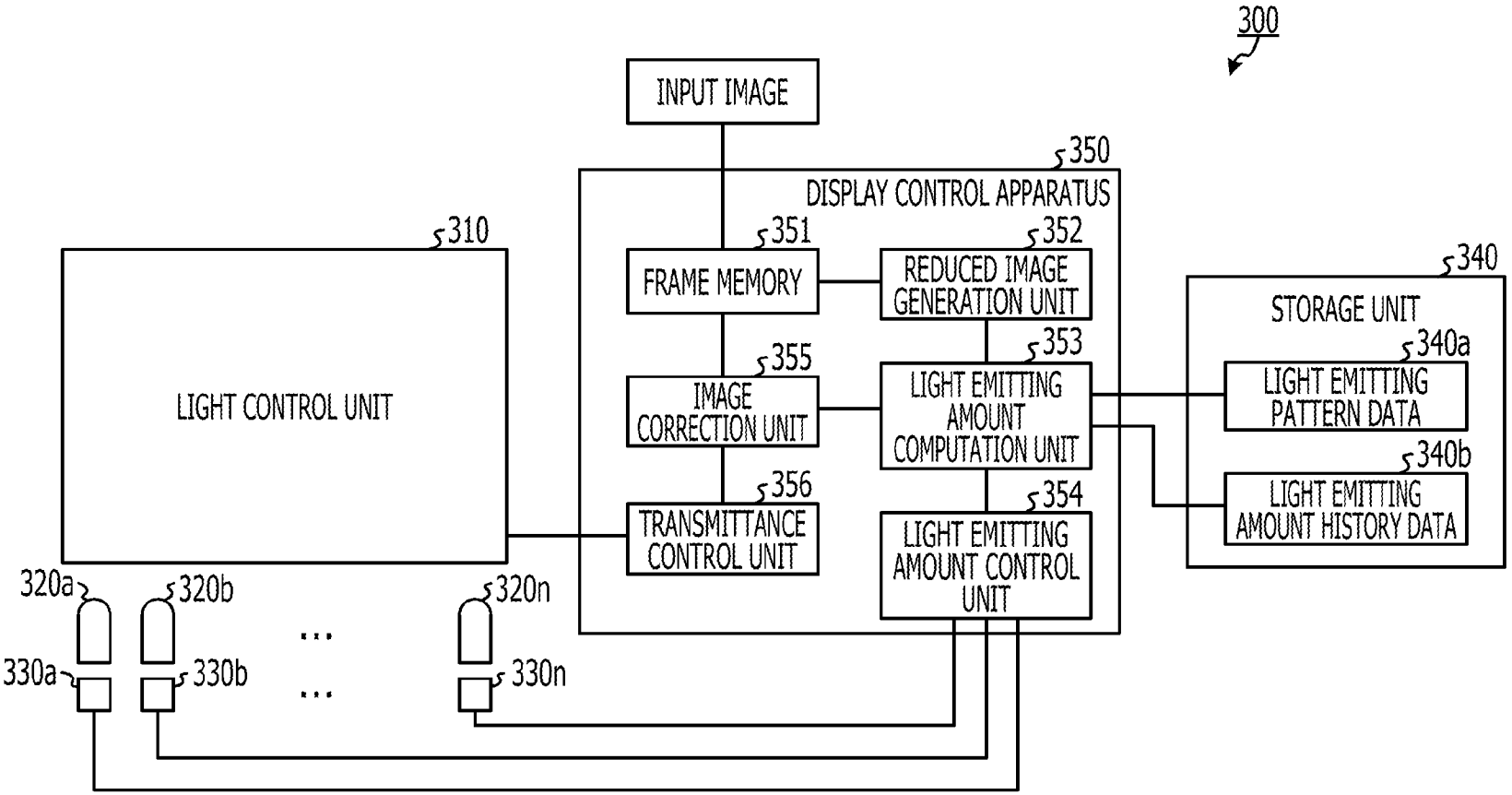
FIG. 18 is a functional block diagram illustrating a configuration of a display apparatus according to a fourth embodiment.

Next, a display apparatus according to a fourth embodiment will be described. FIG. 18 is a functional block diagram illustrating a configuration of the display apparatus according to the fourth embodiment. As illustrated in FIG. 18, this display apparatus 300 has a light control unit 310, light sources 320*a* to 320*n*, drivers 330*a* to 330*n*, a storage unit 340, and a display control apparatus 350.

Among these, a description related to the light control unit 310, the light sources 320*a* to 320*n*, the drivers 330*a* to 330*n*, and the storage unit 340 is similar to the description related to the light control unit 110, the light sources 120*a* to 120*n*, the drivers 130*a* to 130*n*, and the storage unit 140 described the above-mentioned second embodiment. For this reason, the description related to the light control unit 310, the light sources 320*a* to 320*n*, the drivers 330*a* to 330*n*, and the storage unit 340 will be omitted.

The display control apparatus 350 computes the transmittance of the light control unit 310 and the light emitting amount of the light source 320 on the basis of the input image. Then, the display control apparatus 350 controls the transmittance of the light control unit 310 so as to have the computed transmittance. Also, the display control apparatus 350 controls the driver 330 so as to have the computed light emitting amount. The display control apparatus 350 corresponds to an integrated circuit such as an ASIC or an FPGA. Alternatively, the display control apparatus 350 corresponds to an electronic circuit such as a CPU or an MPU.

Herein, the display control apparatus 350 will be specifically described. As illustrated in FIG. 18, the display control apparatus 350 has a frame memory 351, a reduced image generation unit 352, a light emitting amount computation unit 353, a light emitting amount control unit 354, an image correction unit 355, and a transmittance control unit 356.

Among these, a description on the frame memory 351, the reduced image generation unit 352, and the light emitting amount control unit 354 is similar to the description on the frame memory 151, the reduced image generation unit 152, the light emitting amount control unit 154 described according to the second embodiment. Also, a description on the image correction unit 355 and the transmittance control unit 356 is similar to the description on the image correction unit 155 and the transmittance control unit 156 described according to the second embodiment.

The light emitting amount computation unit 353 computes the light emitting amounts of the respective light sources 320. In the following, the processing by the light emitting amount computation unit 353 will be specifically described. First, the light emitting amount computation unit 353 calculates the tentative light emitting amounts of the respective light sources by using a method similar to the light emitting amount computation unit 153 of the above-mentioned second embodiment. The light emitting pattern data 340*a* is similar to the light emitting pattern data 140*a* and 240*a* of the previously described embodiments.

Herein, in the single light source 320, the change in the light emitting amount in the previous time and the change in the light emitting amount in this time may be sorted into the following four patterns. (1) No change in the light emitting amount in the previous time occurs. (2) No change in the light emitting amount in this time occurs. (3) The direction of the change in the light emitting amount in the previous time and the direction of the change in the light emitting amount in this time are the same direction. (4) The direction of the change in the light emitting amount in the previous time and the direction of the change in the light emitting amount in this time are opposite directions. It should be noted that the change in the light emitting amount in the previous time is a change in the light emitting amount of the light source 320 in the previous time that is compared with the light emitting amount of the light source 320 in the last time but one. The change in the light emitting amount in this time is a change in the tentative light emitting amount of the light source 230 in this time that is compared with the light emitting amount of the light source 320 in the previous time in a case where the tentative light emitting amount of the light source 320 in this time is set. Information on the light emitting amount of the light source 320 in the last time but one and the light emitting amount of the light source in the previous time is stored in a light emitting amount history data 340*b*.

The light emitting amount computation unit 353 determines the change in the light emitting amount in the previous time and the change in the light emitting amount in this time to determine to which pattern the changes correspond among the patterns (1) to (4). In a case where it is determined that the changes correspond to the above-mentioned patterns (1) to (3), the light emitting amount computation unit 353 decides the tentatively decided tentative light emitting amount in this time as the final light emitting amount.

On the other hand, in a case where the change in the light emitting amount in the previous time and the change in the light emitting amount in this time correspond to the above-mentioned pattern (4), the light emitting amount computation unit 353 corrects the value of the tentative light emitting amount of the relevant light source 320. For example, the light emitting amount computation unit 353 corrects the tentative light emitting amount of the relevant light source 320 into the light emitting amount in the previous time. The light emitting amount computation unit 353 decides the final light emitting amounts of the respective light sources 320.

Then, the light emitting amount computation unit 353 associates the finally decided light emitting amount to the information on the light source 320 to be output to the light emitting amount control unit 354 and the image correction unit 355. Also, the light emitting amount computation unit 353 associates the finally decided light emitting amount with the respective light sources 320 to be stored in the light emitting amount history data 340*b*.

It should be noted that the light emitting amount computation unit 353 may decide the final light emitting amount through the following first, second, and third methods. First, the first method will be described. The light emitting amount computation unit 353 corrects the tentative light emitting amount in a case where it is determined that this corresponds to the above-mentioned pattern (4) only when the direction of the change in the light emitting amount in this time is the minus direction. The light emitting amount computation unit 353 does not performs the correction on the tentative light emitting amount in a case where the direction of the change in the light emitting amount in this time is the plus direction even when this corresponds to the above-mentioned pattern (4), and the light emitting amount computation unit 353 decides the tentative light emitting amount as the final light emitting amount. In this way, as the light emitting amount computation unit 353 corrects the tentative light emitting amount, it is possible to avoid a risk that the input image is broken.

Subsequently, the second method will be described. In a case where it is determined that corresponds to the above-mentioned pattern (4), the light emitting amount computation unit 353 corrects the tentative light emitting amount so that the change amount from the light emitting amount in the previous time is included in the threshold. For example, in a case where the light emitting amount in the last time but one is N1% and the light emitting amount in the previous time is N2%, the change amount becomes N1%−N2%. In this case, the light emitting amount computation unit 353 corrects the tentative light emitting amount so as to be included within N1%+(N1%−N2%)−T to N1%+(N1%+N2%)−T. T described above denotes a certain value.

Subsequently, the third method will be described. The light emitting amount computation unit 353 utilized an average value of the light emitting amounts of the respective light sources 320 and collectively decides the light emitting amounts of the respective light sources. Herein, an average value of the light emitting amounts of the respective light sources 320 in the last time but one is set as A2, an average value of the light emitting amounts of the respective light sources 320 in the previous time is set as A1, and an average value of the tentative light emitting amounts of the respective light sources 320 in this time is set as A. In this case, a change amount C1 in the light emitting amount in the previous time is represented by C1=A1−A2, and the change amount C2 in the light emitting amount in this time is represented by C=A−A1.

Herein, in a case where a value obtained by subtracting the change amount C1 from the change amount C is larger than or equal to the threshold T, the light emitting amount computation unit 353 decides values obtained by respectively subtracting "C−C1−T" from the tentative light emitting amounts of the respective light sources 320 as the final light emitting amounts. For example, the light emitting amount computation unit 353 sets the threshold T as 10%. It should be noted that in a case where the values obtained by subtracting "C−C1−T" from the tentative light emitting amounts are smaller than 0%, the light emitting amount computation unit 353 sets the final light emitting amounts as 0%.

On the other hand, in a case where values obtained by subtracting the change amount C1 from the change amount C are smaller than the threshold −T, the light emitting amount computation unit 353 decides value obtained by adding "C−C1+T" respectively to the tentative light emitting amounts of the respective light sources 320 as the final light emitting amounts. For example, the light emitting amount computation unit 353 sets the threshold −T as −10%. It should be noted that in a case where the values obtained by adding "C−C1−T" to the tentative light emitting amount are larger or equal to 100%, the light emitting amount computation unit 353 sets the final light emitting amounts as 100%. In this way, it is possible to simplify the processing as the light emitting amount computation unit 353 collectively decides the final light emitting amounts of the respective light sources.

Figure 19:
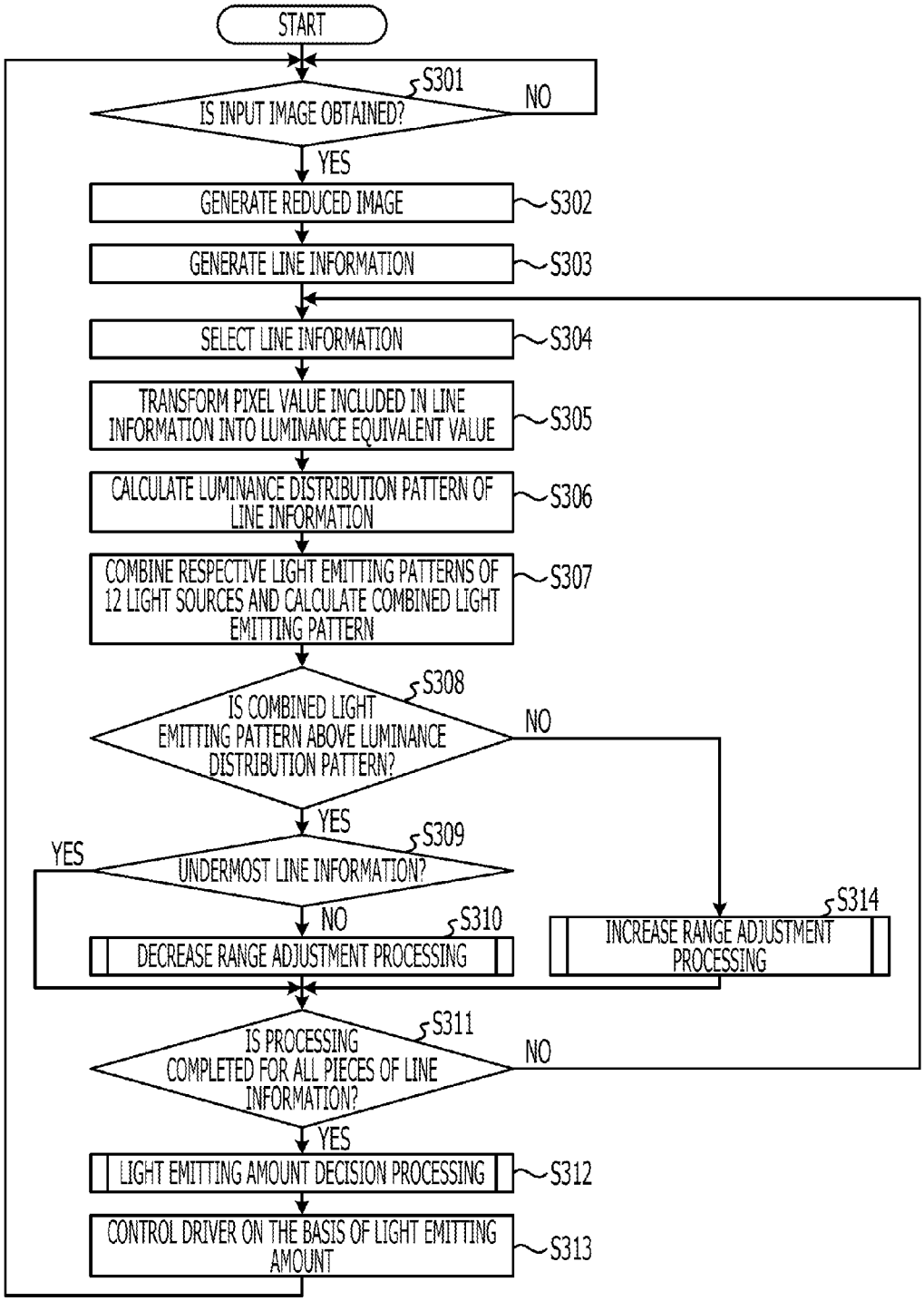
FIG. 19 is a flow chart illustrating a processing procedure by the display apparatus according to the fourth embodiment.

Next, a processing procedure by the display apparatus 300 according to the fourth embodiment will be described. FIG. 19 is a flow chart illustrating a processing procedure by the display apparatus 300 according to the fourth embodiment. According to the flow chart illustrated in FIG. 19, for example, the processing is started in a case where the input image is obtained from the external apparatus. Also, it is supposed that the initial values of the light emitting amounts of the respective light sources are stored in the light emitting amount history data 340*b*. Also, in the description of FIG. 19, as an example, the number of the light sources 320 is set as 12.

As illustrated in FIG. 19, this display apparatus 300 determines whether or not the input image is obtained (S301). In a case where the input image is not obtained (S301, No), this display apparatus 300 shifts to S301 again.

In a case where the input image is obtained (S301, Yes), this display apparatus 300 generates a reduced image (S302) and generate line information (S303). This display apparatus 300 selects the line information (S304) and transforms a pixel value included in the line information into a luminance equivalent value (S305).

This display apparatus 300 calculates the luminance distribution pattern of the line information (S306). This display apparatus 300 combines the respective light emitting pattern of the 12 light sources 320 and calculates the combined light emitting pattern (S307).

In a case where the combined light emitting pattern is above the luminance distribution pattern (S308, Yes), this display apparatus 300 determines whether or not this is the undermost line information (S309). In a case where this is the undermost line information (S309, Yes), this display apparatus 300 shifts to S311.

On the other hand, in a case where this is not the undermost line information (S309, No), the display apparatus 300 executes the decrease range adjustment processing (S310). In the case where the processing on all the pieces of line information is not completed (S311, No), this display apparatus 300 shifts to S304 again.

In the case where the processing on all the pieces of line information is completed (S311, Yes), this display apparatus 300 executes the light emitting amount decision processing (S312). This display apparatus 300 controls the driver 330 on the basis of the light emitting amount (S313) and shifts to S301 again.

Incidentally, in S308, in a case where the combined light emitting pattern is not above the luminance distribution pattern (S308, No), this display apparatus 300 executes the increase range adjustment processing (S314) and shifts to S311.

Herein, the decrease range adjustment processing in S310 of FIG. 19 is similar to the decrease range adjustment processing illustrated in S110 of FIG. 10. Also, the increase range adjustment processing in S314 of FIG. 19 is similar to the increase range adjustment processing illustrated in S114 of FIG. 10.

Figure 20:
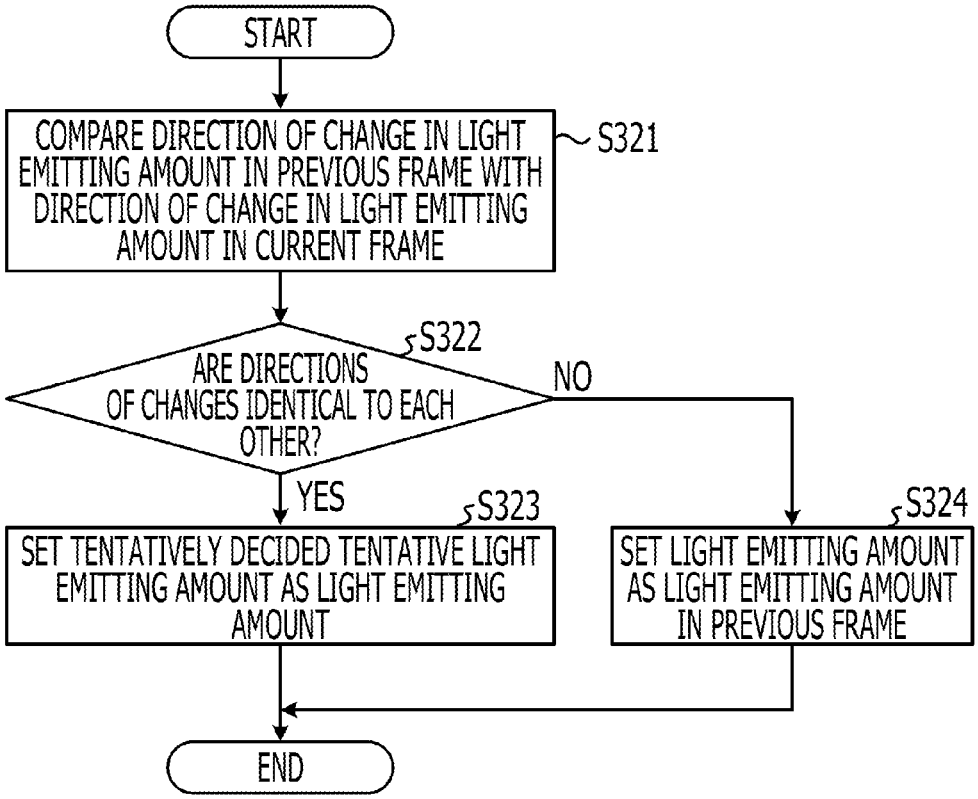
FIG. 20 is a flow chart illustrating a processing procedure of a light emitting amount decision processing according to the fourth embodiment.

Subsequently, the light emitting amount decision processing illustrated in S312 of FIG. 19 will be described. FIG. 20 is a flow chart illustrating a processing procedure of a light emitting amount decision processing according to the fourth embodiment. As illustrated in FIG. 20, the light emitting amount computation unit 353 compares the direction of the change in the light emitting amount in the previous frame with the direction of the change in the light emitting amount in the current frame (S321).

In a case where the directions of the changes are identical to each other (S322, Yes), the light emitting amount computation unit 353 decides the tentative light emitting amount as the final light emitting amount (S323). Then, the light emitting amount computation unit 353 ends the light emitting amount decision processing.

On the other hand, in a case where the directions of the changes are different from each other (S322, No), the light emitting amount computation unit 353 sets the light emitting amount as the light emitting amount in the previous frame (S324). Then, the light emitting amount computation unit 353 ends the light emitting amount decision processing. It should be noted that the light emitting amount computation unit 353 illustrated in FIG. 20 is configured to decide the light emitting amount for each of the light sources 320 as in the above-mentioned description.

This display apparatus 300 according to the present fourth embodiment imposes a limit on the change in the light emitting amount for each light source on the basis of the comparison result between the direction of the change in the light emitting amount in the previous time with the direction of the change in the light emitting amount in this time. Then, this display apparatus 300 finally decides the light emitting amount in this time on the basis of the limit. For example, in a case where the direction of the change in the light emitting amount in the previous time and the direction of the change in the light emitting amount in this time are different from each other, with regard to the tentative light emitting amount having one of the directions, this display apparatus 300 does not adopt the tentative light emitting amount. Then, for the light emitting amounts of a part of the light sources, this display apparatus 300 sets the light emitting amount in the previous time as the light emitting amount. As this display apparatus 300 adjusts the final light emitting amounts, the change in the change direction of the light emitting amount for each frame is prevented. Then, this display apparatus 300 may prevent the white flicker and the black flicker from generating temporally continuously.

It should be noted that in a case where the tentative light emitting amount is calculated through the above-mentioned second method, this display apparatus 300 may skip the light emitting amount decision processing illustrated in S312 of FIG. 19. That is, in a case where the tentative light emitting amount is calculated through the above-mentioned second method, this display apparatus 300 may decide the relevant tentative light emitting amount as the final light emitting amount as it is.

Also, in this display apparatus 300 according to the present fourth embodiment, it is supposed that a plurality of light sources exist, but the configuration is not limited to this. For example, also in a case where a single light source exists, this display apparatus 300 may optimally set the light emitting amount of the light source. In this case, after the tentative light emitting amount in the current frame corresponding to the single light source is calculated, this display apparatus 300 may execute the processing illustrated in FIG. 20. As this display apparatus 300 executes the above-mentioned processing, even in a case where the single light source is used, it is possible to suppress the flicker that may be generated in a case where the temporally continuous frame is switched over. Also, in a case where the single light source is used, the light source 320 and the driver 330 illustrated in FIG. 18 are a single component.

The respective components such as the display apparatus 100 illustrated in the above-mentioned embodiments 1 to 4 are like functional concepts and are not necessarily required to be configured physically as illustrated. That is, a specific mode of integration and distribution of the display apparatus 100 is not limited to the illustrated mode. For example, the reduced image generation unit 152, the light emitting amount computation unit 153, and the light emitting amount control unit 154 may be integrated functionally or physically. Also, the light emitting amount computation unit 153 may be distributed functionally. For example, the light emitting amount computation unit 153 may be distributed into a functional unit that control the flow of the entire processing illustrated in FIG. 10, a functional unit that executes the decrease range adjustment processing illustrated in FIG. 11, and a functional unit that executes the increase range calculation processing illustrated in FIG. 12. In this way, all or a part of the display apparatus 100 may be configured through functional or physical distribution or integration in an arbitrary unit in accordance with various loads or usage states.

Incidentally, the processing described according to the above-mentioned embodiments by the display apparatus 100 or the like may also be realized by executing a previously prepared program by a computer system such as a personal computer or a work station.

Figure 21:
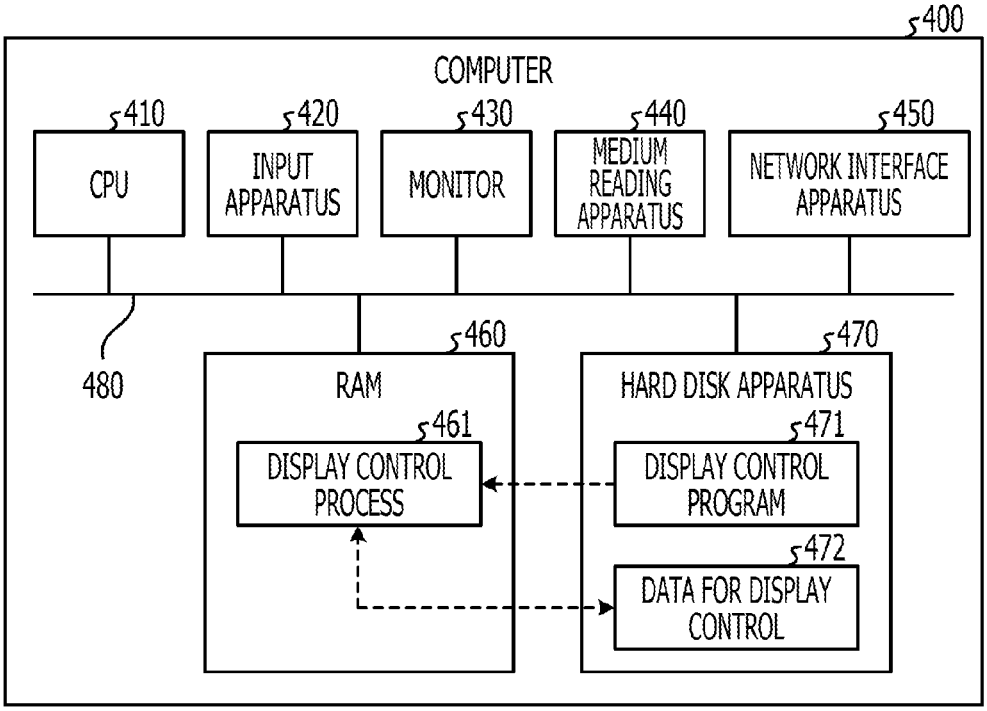
FIG. 21 illustrates an exemplary computer that executes a display control program.
Figure 22:
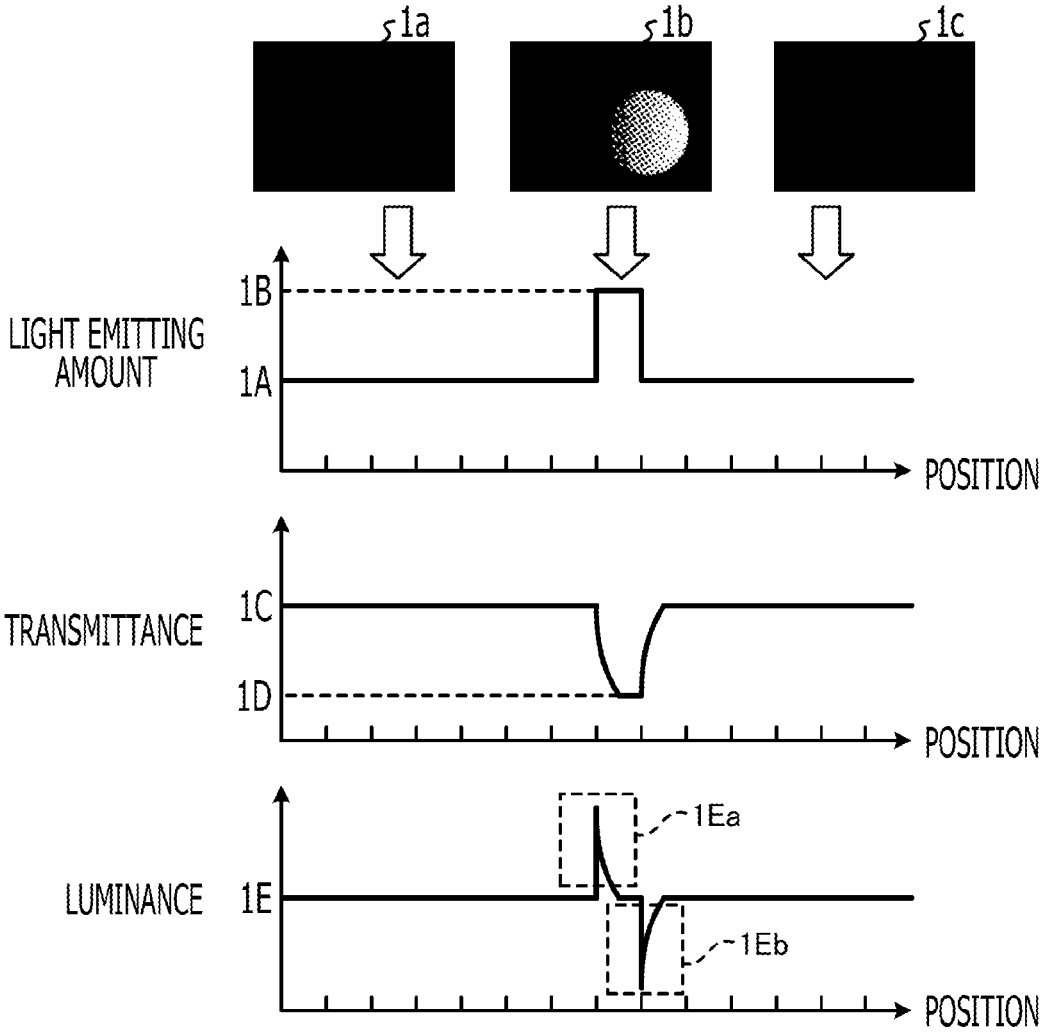
FIG. 22 is an explanatory diagram (1) for describing flicker generated in a flat section.
Figure 23:
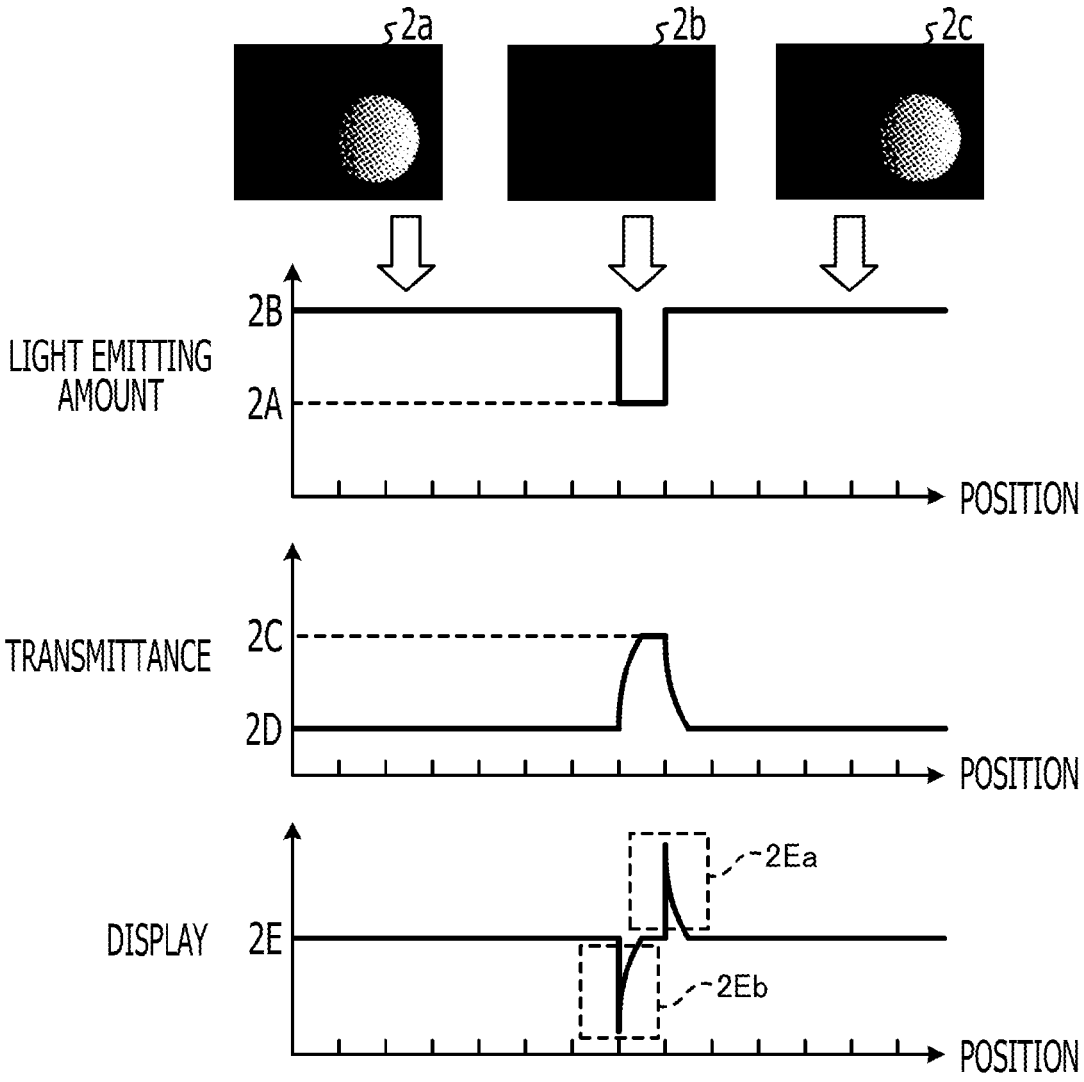
FIG. 23 is an explanatory diagram (2) for describing the flicker generated in the flat section.

In view of the above, by using FIG. 21, a description will hereinafter be given of an exemplary computer that executes a display control program realizing a similar function to the processing described according to the above-mentioned embodiments by the display apparatus 100. FIG. 21 illustrates an exemplary computer that executes a display control program.

As illustrated in FIG. 21, a computer 400 functioning as the display apparatus 100 has a CPU (Central Processing Unit) 410 that executes various computation processings, an input apparatus 420 that accepts an input of data from a user, and a monitor 430 including the light control unit 410.

Also, as illustrated in FIG. 21, the computer 400 has a medium reading apparatus 440 that reads a program or the like from a storage medium and a network interface apparatus 450 that performs transmission and reception of data with another computer via a network. Also, the computer 400 has a RAM (Random Access Memory) 460 that temporarily stores various pieces of information and a hard disk apparatus 470. Then, the respective apparatuses 410 to 470 are connected to a bus 480.

The hard disk apparatus 470 stores a display control program 471 that exercises a function similar to the above-mentioned function of the display apparatus 100 and display control data 472. It should be noted that by appropriately distributing the display control program 471, it is also possible to store the program in a storage unit of another computer connected to be communicable via the network.

Then, as the CPU 410 reads out the display control program 471 from the hard disk apparatus 470 to be expanded to the RAM 460, as illustrated in FIG. 21, the display control program 471 functions as a display control process 461. The display control process 461 appropriately expands information or the like read from the display control data 472 onto an area allocated to itself on the RAM 460 and executes various processings on the basis of these various pieces of expanded data. Herein, the display control process 461 corresponds, for example, to the processing executed in the reduced image generation unit 152, the light emitting amount computation unit 153, the light emitting amount control unit 154, and the image correction unit 155 illustrated in FIG. 2.

It should be noted that the display control program 471 is not necessarily stored in the hard disk apparatus 470 from the beginning. For example, the respective programs are stored in "portable physical media" such as a flexible disk (FD), a CD-ROM, a DVD disk, an opto-magnetic disk, and an IC card to be inserted into the computer 400. Then, the computer 400 may read out the respective program from these for execution.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present inventions has been described in detail, it should be understood that various changes, substitutions, and alterations could be made hereto without departing from the spirit and scope of the invention.

What is claimed is:

1. A display apparatus comprising:

a plurality of light sources;

a display panel configured to output a display image based on an input image, with using irradiation by the plurality of light sources; and a processor coupled to a memory, configured to:

accept a first input image and a second input image, compute a first light emitting amount of each of the plurality of light sources based on a luminance of the first input image, compute a tentative light emitting amount based on a luminance of the second input image of each of the plurality of light sources, on a basis of a comparison result between the first light emitting amount and the tentative light emitting amount, impose a limit on a change range from the first light emitting amount to a second light emitting amount of each of the plurality of light sources, and decide the second light emitting amount in a case where the display image is outputted based on the second input image in accordance with the limit;

control each of the plurality of light sources on the basis of the second light emitting amount;

wherein the processor is configured to accept a third input image prior to the first input image and the second input image, and wherein processor is configured to compute a third light emitting amount of each of the plurality of light sources based on the third input image and decides the second light emitting amount based on the first light emitting amount, the tentative light emitting amount, and the third light emitting amount; and wherein the processor is configured to set a value of the second light emitting amount within a range from a value of the first light emitting amount based on the limit in a case where a light emission change from the third light emitting amount to the first light emitting amount and another light emission change from the first light emitting amount to the tentative light emitting amount are different from each other;

wherein the processor determines whether a direction of the change from the first light emitting amount to the tentative light emitting amount is on a plus side or a minus side for each light source of said plurality of light sources and imposes a limit of prohibiting light emission at the tentative light emitting amount in each of the light sources of said plurality of light sources whose change is sorted into a minority side among the plus side and the minus side.

2. The display apparatus according to claim 1, wherein the processor is configured to impose a second limit on a light emission change from the first light emitting amount.

3. The display apparatus according to claim 2, wherein the processor is configured to determine whether the light emission change from the first light emitting amount to the tentative light emitting amount is a first direction or a second direction with regard to each of the plurality of light sources and imposes the second limit of prohibiting light emission at the tentative light emitting amount on the light source in which the tentative light emitting amount having either light emission change of the first direction or the second direction is set among the plurality of light sources.

4. The display apparatus according to claim 3, wherein the processor is configured to identify the light emission change into which fewer light sources are sorted among the first direction and the second direction as a result of sorting the light emission change of each of the plurality of light sources and decides the second light emitting amount of the light source sorted into the identified light emission change as the first light emitting amount.

5. The display apparatus according to claim 1, wherein the processor is configured to set the value of the second light emitting amount as the value of the first light emitting amount based on the limit in a case where the light emission change from the third light emitting amount to the first light emitting amount and the another light emission change from the first light emitting amount to the tentative light emitting amount are different from each other.

6. A display apparatus comprising:

a plurality of light sources;

a display panel configured to output a display image based on an input image, with using irradiation by the plurality of light sources; and a processor coupled to a memory, configured to:

accept a first input image and a second input image, detect a change in luminance from the first input image to the second input image based on the first input image and the second input image, compute a first light emitting amount of each of the plurality of light sources based on a luminance of the first input image and decide a second light emitting amount of each of the plurality of light sources based on the change in luminance and the first light emitting amount in a case where the second input image is displayed, control each of the plurality of light sources based on the second light emitting amount;

wherein the processor is configured to accept a third input image prior to the first input image and the second input image, and wherein processor is configured to compute a third light emitting amount of each of the plurality of light sources based on the third input image and decides the second light emitting amount based on the first light emitting amount, the tentative light emitting amount, and the third light emitting amount; and wherein the processor is configured to set a value of the second light emitting amount within a range from a value of the first light emitting amount based on the limit in a case where a light emission change from the third light emitting amount to the first light emitting amount and another light emission change from the first light emitting amount to the tentative light emitting amount are different from each other;

wherein the processor determines whether a direction of the change from the first light emitting amount to the tentative light emitting amount is on a plus side or a minus side for each light source of said plurality of light sources and imposes a limit of prohibiting light emission at the tentative light emitting amount in each of the light sources of said plurality of light sources whose change is sorted into a minority side among the plus side and the minus side.

7. The display apparatus according to claim 6, wherein the processor is configured to compute a change allowable range from the first light emitting amount to the second light emitting amount based on the change in luminance and a change amount of the change in luminance and set the second light emitting amount as a value within the computed change allowable range.

8. A display method executed by a display apparatus including a plurality of light sources and a display panel which outputs a display image based on an input image with using radiation by the plurality of light sources, the method comprising:

accepting a first input image;

computing a first light emitting amount of each of the plurality of light sources based on a luminance of the first input image;

accepting a second input image after the first input image;

computing a tentative light emitting amount of each of the plurality of light sources based on a luminance of the second input image;

comparing the first light emitting amount with the tentative light emitting amount;

imposing a limit on a change range from the first light emitting amount based on a comparison result;

deciding, using a processor, a second light emitting amount at which each of the plurality of light sources emits light based on the limit in a case where the display image is outputted based on the second input image in accordance with the limit;

controlling each of the plurality of light sources based on the second light emitting amount;

accepting a third input image prior to the first input image and the second input image; and computing a third light emitting amount of each of the plurality of light sources based on the third input image, wherein the deciding the second light emitting amount includes deciding the second light emitting amount based on the first light emitting amount, the tentative light emitting amount, and the third light emitting amount; and wherein the deciding the second light emitting amount includes setting a value of the second light emitting amount as a value within a range from a value of the first light emitting amount based on the limit in a case where a light emission change from the third light emitting amount to the first light emitting amount and another light emission change from the first light emitting amount to the tentative light emitting amount are different from each other;

wherein the processor determines whether a direction of the change from the first light emitting amount to the tentative light emitting amount is on a plus side or a minus side for each light source of said plurality of light sources and imposes a limit of prohibiting light emission at the tentative light emitting amount in each of the light sources of said plurality of light sources whose change is sorted into a minority side among the plus side and the minus side.

9. The display method according to claim 8, wherein the imposing the limit includes further imposing a second limit on a light emission change from the first light emitting amount.

10. The display method according to claim 9, wherein the imposing the limit includes determining whether the light emission change from the first light emitting amount to the tentative light emitting amount is a first direction or a second direction with regard to each of the plurality of light sources and imposing the second limit of prohibiting light emission at the tentative light emitting amount on the light source in which the tentative light emitting amount having either light emission change of the first direction or the second direction is set among the plurality of light sources.

11. The display method according to claim 8, wherein the deciding the second light emitting amount includes setting the value of the second light emitting amount as the value of the first light emitting amount based on the limit in a case where the light emission change from the third light emitting amount to the first light emitting amount and the another light emission change from the first light emitting amount to the tentative light emitting amount are different from each other.

12. A display apparatus comprising:

a light source;

a display panel configured to output a display image based on an input image, with using irradiation by the light source; and a processor coupled to a memory, configured to:

accept a third input image prior to a first input image and a second input image and accept the first input image and the second input image, output a display image on the basis of the first input image, the second input image, or the third input image, compute a first light emitting amount of the light source based on a luminance of the first input image, computes a tentative light emitting amount of the light source based on a luminance of the second input image, compute a third light emitting amount based on a luminance of the third input image, set a limit on a change range from the first light emitting amount based on the first light emitting amount, the tentative light emitting amount, and the third light emitting amount, and decide a second light emitting amount of the light source in a case where the second input image is displayed based on the limit, control the light source based on the second light emitting amount;

wherein the processor is configured to decide the second light emitting amount based on the first light emitting amount, the tentative light emitting amount, and the third light emitting amount; and wherein the processor is configured to set the value of the second light emitting amount as the value of the first light emitting amount based on the limit in a case where the light emission change from the third light emitting amount to the first light emitting amount and the another light emission change from the first light emitting amount to the tentative light emitting amount are different from each other;

wherein the processor determines whether a direction of the change from the first light emitting amount to the tentative light emitting amount is on a plus side or a minus side for each light source of said plurality of light sources and imposes a limit of prohibiting light emission at the tentative light emitting amount in each of the light sources of said plurality of light sources whose change is sorted into a minority side among the plus side and the minus side.

13. A display apparatus comprising:

a plurality of light sources;

a display panel configured to output a display image based on an input image, with using irradiation by the plurality of light sources; and a processor coupled to a memory, configured to:

accept a first input image and a second input image, compute a first light emitting amount of each of the plurality of light sources based on a luminance of the first input image, compute a tentative light emitting amount based on a luminance of the second input image of each of the plurality of light sources, on a basis of a comparison result between the first light emitting amount and the tentative light emitting amount, impose a limit on a change range from the first light emitting amount to a second light emitting amount of each of the plurality of light sources, and decide the second light emitting amount in a case where the display image is outputted based on the second input image in accordance with the limit;

control each of the plurality of light sources on the basis of the second light emitting amount;

wherein processor is configured to impose a second limit on a light emission change from the first light emitting amount;

wherein the processor is configured to determine whether the light emission change from the first light emitting amount to the tentative light emitting amount is a first direction or a second direction with regard to each of the plurality of light sources and imposes the second limit of prohibiting light emission at the tentative light emitting amount on the light source in which the tentative light emitting amount having either light emission change of the first direction or the second direction is set among the plurality of light sources;

wherein the processor is configured to identify the light emission change into which fewer light sources are sorted among the first direction and the second direction as a result of sorting the light emission change of each of the plurality of light sources and decides the second light emitting amount of the light source sorted into the identified light emission change as the first light emitting amount;

wherein the processor determines whether a direction of the change from the first light emitting amount to the tentative light emitting amount is on a plus side or a minus side for each light source of said plurality of light sources and imposes a limit of prohibiting light emission at the tentative light emitting amount in each of the light sources of said plurality of light sources whose change is sorted into a minority side among the plus side and the minus side.

* * * * *